US006789614B2

(12) United States Patent
Sin et al.

(10) Patent No.: US 6,789,614 B2
(45) Date of Patent: Sep. 14, 2004

(54) HEAT EXCHANGER FOR REFRIGERATOR

(75) Inventors: Jong Min Sin, Pusan Kwangyok-shi (KR); Bong Jun Choi, Changwon-si (KR); Cheol Hwan Kim, Changwon-si (KR); Seong Hai Jeong, Changwon-si (KR); Young Hwan Ko, Seoul (KR); Young Jeong, Changwon-si (KR); Sam Chul Ha, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/149,513

(22) PCT Filed: Feb. 28, 2002

(86) PCT No.: PCT/KR02/00354

§ 371 (c)(1),
(2), (4) Date: Jun. 12, 2002

(87) PCT Pub. No.: WO03/073024

PCT Pub. Date: Sep. 4, 2003

(65) Prior Publication Data

US 2003/0159814 A1 Aug. 28, 2003

(51) Int. Cl.[7] ..... F28D 1/04
(52) U.S. Cl. ..... 165/151; 165/182; 62/515
(58) Field of Search ..... 165/182, 151, 165/152, DIG. 522, DIG. 523; 62/515

(56) References Cited

U.S. PATENT DOCUMENTS

| | | | | | |
|---|---|---|---|---|---|
| 2,613,065 | A | * | 10/1952 | Ware | 165/146 |
| 3,313,123 | A | * | 4/1967 | Didier | 62/272 |
| 4,480,684 | A | | 11/1984 | Onishi et al. | |
| 6,253,839 | B1 | * | 7/2001 | Reagen et al. | 165/151 |
| 6,354,367 | B1 | * | 3/2002 | Gong et al. | 165/125 |
| 2002/0023744 | A1 | * | 2/2002 | Kim et al. | 165/177 |

FOREIGN PATENT DOCUMENTS

| | | | | | |
|---|---|---|---|---|---|
| DE | 26 38 481 | | | 8/1976 | |
| GB | 2 263 539 | A | | 7/1993 | |
| JP | 61-143695 | A | * | 7/1986 | 165/151 |
| JP | 64-57094 | A | * | 3/1989 | 165/151 |
| JP | 5-157478 | A | * | 6/1993 | 165/151 |
| JP | 5-240534 | | | 9/1993 | |

* cited by examiner

*Primary Examiner*—Terrell McKinnon
(74) *Attorney, Agent, or Firm*—Fleshner & Kim, LLP

(57) ABSTRACT

A heat exchanger is provided for a refrigerator and includes one or more refrigerant tubes for refrigerant flow, and a plurality of straight fins having lengths different from each other fitted to the refrigerant tubes at fixed intervals in parallel to each other by means of through holes formed therein. The heat exchanger includes sections having different intervals or spaces between fins, wherein sections with the smallest fin spaces have a size 75% or less of a total size of the heat exchanger.

69 Claims, 35 Drawing Sheets

• Arrangement Pattern : P1 (space ratio: $2 \cdot 2^{(n-1)} (n \geq 1)$)

• Arrangement Pattern : P2 (space ratio: $3 \cdot 2^{(n-1)} (n \geq 1)$ )

• Arrangement Pattern : P3 (space ratio: $4 \cdot 2^{(n-1)} (n \geq 1)$)

• Arrangement Pattern : P1 (space ratio: $2 \cdot 2^{(n-1)} (n \geq 1)$)

• Arrangement Pattern : P1 (space ratio: $2 \cdot 2^{(n-1)} (n \geq 1)$)

• Arrangement Pattern : P1 (space ratio: $2 \cdot 2^{(n-1)} (n \geq 1)$)

HEAT EXCHANGER FOR REFRIGERATOR

This application claims priority to PCT/KR02/00354, filed Feb. 28, 2002.

TECHNICAL FIELD

The present invention relates to a fin-tube type heat exchanger, and more particularly, to a heat exchanger applied to a refrigerator for producing cold air to be supplied to a refrigerating chamber and a freezing chamber.

BACKGROUND ART

In addition to the refrigerating chamber and the freezing chamber separated from each other, the refrigerator is provided with a so called machine room in a lower part thereof, and air passages in a rear part of the refrigerating chamber and the freezing chamber connected thereto. The heat exchanger (evaporator) is fitted on the air passages, together with a fan, for supplying cold air to the refrigerating chamber and the freezing chamber in association with a compressor and condensers in the machine room. That is, high temperature and high pressure refrigerant supplied through the compressor and the condensers is evaporated in the heat exchanger, to cool down environmental air by a latent heat of the vaporization. The fan circulates air throughout the refrigerator for supplying the air cooled down through the heat exchanger to the refrigerating chamber and the freezing chamber, continuously.

A related art heat exchanger for the refrigerator is illustrated in FIGS. 1 and 2, referring to which the related art heat exchanger will be explained.

As shown, the heat exchanger is provided with refrigerating tube 1 for flow of the refrigerant, and a plurality of fins 1 fitted at fixed intervals parallel to one another along the refrigerating tube 1.

In more detail, the refrigerating tube 1 is coupled with the fins 2 while one line of the refrigerating tube 1 forms one column in the heat exchanger. FIG. 2 illustrates two columns formed by two lines of refrigerating tube 1.

As shown in FIG. 2, the fin 2, actually in a form of small plate, has through holes 2*a* for coupling with the refrigerating tube 1. That is, the related art heat exchanger has discrete fins 2, to form discrete heat exchange surfaces along a length of the heat exchanger.

Moreover, during operation, much moisture in the air in the refrigerator is frosted on surfaces of the heat exchanger owing to a subzero environmental temperature, to impede circulation of the air. Therefore, in general, there is defroster 3 provided to the heat exchanger for defrosting, for which separate defrosting process is conducted.

The heat exchanger is fitted to stand upright in the air flow passage, and the air in the refrigerator is introduced into the heat exchanger from below and exits from a top of the heat exchanger as shown in arrows.

Currently, despite the foregoing heat exchangers are applied to most of the refrigerators, the heat exchangers have the following structural problems, actually.

For an example, the fins 2 are fitted to the refrigerating tube 1 one by one because the fins 2 are discrete and have individual shape characteristics. The fins 2 are fitted along the refrigerating tube at intervals different from each other between an upper part and a lower part thereof. That is, as a flow resistance caused by the growth of the frost deteriorates a heat exchanger performance, the fins 2 are fitted in the lower part, an air inlet side, that has more frosting at intervals larger than the upper part.

Water from the defrosting stays at lower edges 2*b* of the fins 2 in a form of a relatively big water drop by surface tension, and acts as nuclei of frost growth in a subsequent operation of the refrigerator (cooling process), again. Therefore, in order to suppress the growth of the frost, as shown, it is required that the defroster is arranged so as to be in contact with every lower edge 2*a*.

At the end, the use of the discrete type of fins makes a structure of the related art heat exchanger complicate actually, that makes assembly difficult. Moreover, it is preferable that the heat exchanger is small sized and has a high efficiency because the heat exchanger is placed in the comparatively small air flow passage. However, the foregoing structural problem impedes design change of the related art heat exchanger, for optimization of the heat exchanger.

DISCLOSURE OF INVENTION

The object of the present invention, devised for solving the foregoing problems, lies on providing a heat exchanger for a refrigerator, which has a simple structure, and is easy to fabricate.

Another object of the present invention is to provide a heat exchanger for a refrigerator having an improved heat exchange performance.

To achieve the objects of the present invention, there is provided a heat exchanger for a refrigerator including refrigerating tubes for flow of refrigerant, and a plurality of straight fins having lengths different from one another for coupling with the refrigerating tubes in parallel to each other at fixed intervals through pass through holes formed therein, to form sections with fin spaces different from one another, wherein a section with the smallest fin spaces is below 75% of an entire size.

The section with the smallest fin space is more than 5% of the entire size, and the smallest fin space is 1 mm–13 mm.

Preferably, the section with the smallest fin space is 5%–65% of the entire size, and the smallest fin space is 2 mm–12 mm. It is more preferable that the section with the smallest fin space is more than 15%–55% of the entire size, and the smallest fin space is 4 mm–10 mm.

In the set up section ratios, the fin space increases by $2\cdot2^{(n-1)}$ times of the smallest fin space, where $n\geqq1$.

The generalized fin spaces are formed by an arrangement pattern having the longest one pair of fins. Fins with intermediate lengths arranged between the one pair of the longest fins, and the shortest fins arranged in every space between the one pair of the longest fins and the fins with intermediate lengths, wherein the spaces between adjacent fins have a ratio of 1:2:4.

The fin space increases by $3\cdot2^{(n-1)}$ times of the fin space of the section with the smallest fin spaces, and the section with the smallest fin spaces is 15%–75% of the entire size, where $n\geqq1$, and the smallest fin space is 3 mm–13 mm.

Preferably, the section with the smallest fin space is 25%–65% of the entire size, and the smallest fin space is 5 mm–12 mm.

The fin spaces are formed by an arrangement pattern having the longest one pair of fins, fins with intermediate lengths arranged between the one pair of the longest fins, and the shortest two fins arranged in every space between the one pair of the longest fins and the fins with intermediate lengths, wherein the spaces between adjacent fins have a ratio of 1:3:6.

The fin space increases by $4\cdot2^{(n-1)}$ times of the fin space of the section with the smallest fin spaces, and the section with the smallest fin spaces is 25%–75% of the entire size, where n≧1, and the smallest fin space is 5 mm–15 mm.

Preferably, the section with the smallest fin spaces is 35%–75% of the entire size, and the smallest fin space is 6 mm–13 mm.

The fin spaces are formed by an arrangement pattern having the longest one pair of fins, fins with intermediate lengths arranged between the one pair of the longest fins, and the shortest two fins arranged in every space between the one pair of the longest fins and the fins with intermediate lengths, wherein the spaces between adjacent fins have a ratio of 1:4:8.

When the section with the smallest fin spices is 5%–75%, 5%–65%, and 15%,–55% of the entire size, the section with the largest fin space is 18% of the entire size, and the smallest fin space is 5.5 mm–10 mm, and more preferably, 6.1 mm–9.1 mm.

When the section with the smallest fin spaces is 5%–75%, the section with the largest fin space may be 18%–25% of the entire size, and the smallest fin space is 6.0 mm–8.5 mm, and more preferably, 6.2 mm–7.7 mm.

When the section with the smallest fin spaces is 5%–65%, and 15%–55%, the section with the largest fin space may be 18%–35% of the entire size, and the smallest fin space is 6.1 mm–8.2 mm, and more preferably, 6.5 mm–7.7 mm.

Preferably, the fin has a top edge and a bottom edge, both are sloped at an angle, and, more preferably, the top and bottom edges are sloped in the same directions.

In more detail, the bottom edge may include a single slope or a plurality of slopes. The slope may have one bottom, or one peak, or a plurality of peaks and bottoms.

More preferably, the fins are arranged such that no tips of the bottom edges with the slope or slopes face each other. The bottom edges with single slopes may be arranged to cross each other, alternately. Or, the bottom edge with a single peak and the bottom edge with a single bottom may be arranged; alternately.

Preferably, the slope angle of the bottom edge may be within 20°–30°, and more preferably within 23°.

More preferably, the fin includes a plurality of slits and louvers formed along a length direction thereof. The slits and louvers are on either face of the fin, or both faces of the fin, alternately. In the foregoing cases, it is preferable that slits and louvers on adjacent fins are arranged, alternately.

In the meantime, preferably, the heat exchanger of the present invention further includes one pair of reinforcing plates coupled to opposite ends of straight parts of refrigerating tube in parallel to the arranged fins. The reinforcing plate includes at least one slit for communication with the slits in the fins, and the bottom edge sloped at an angle.

The heat exchanger of the present invention further includes a defroster fitted to the heat exchanger spaced a fixed distance from the bottom edges of the fins for removal of frost on the refrigerating tube and the fins. The defroster is arranged to keep in contact with middle parts of the fins and the reinforcing plates. To do this, the fins and the reinforcing plates include notches for receiving the defroster.

The present invention actually simplifies a structure and assembly of the heat exchanger, and improves a heat exchange performance. Accordingly, the heat exchanger of the present invention is optimized to suit to a refrigerator.

BRIEF DESCRIPTION OF DRAWINGS

It is to be understood that both the foregoing general description and the following detailed description are exemplary and explanatory and are intended to provide further explanation of the invention as claimed.

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates a front view of a related art heat exchanger for a refrigerator;

FIG. 2 illustrates a side sectional view across a line I—I in FIG. 1;

FIG. 3A illustrates a front view of a heat exchanger for a refrigerator in accordance with a preferred embodiment of the present invention;

FIG. 3B illustrates a side sectional view across a line II—II in FIG. 3A;

FIG. 4A illustrates a front view of a heat exchanger for a refrigerator having a variation of a refrigerating tube arrangement in accordance with a preferred embodiment of the present invention;

FIG. 4B illustrates a side sectional view across a line III—III in FIG. 4A;

FIG. 5 illustrates a graph showing amounts of remained defrosted water per a unit area of fin of the related art and the present invention;

FIG. 6 illustrates a graph showing, operation time period vs. pressure loss of the related art and the present invention;

FIG. 7 illustrates a front view of a heat exchanger of the present invention having fins with different lengths;

FIG. 8 illustrates a perspective view of a part of a heat exchanger showing a fin arrangement pattern of FIG. 7;

FIGS. 9A–9C illustrate fin arrangement patterns in accordance with a preferred embodiment, and variations thereof of the present invention, schematically;

Figure 10:
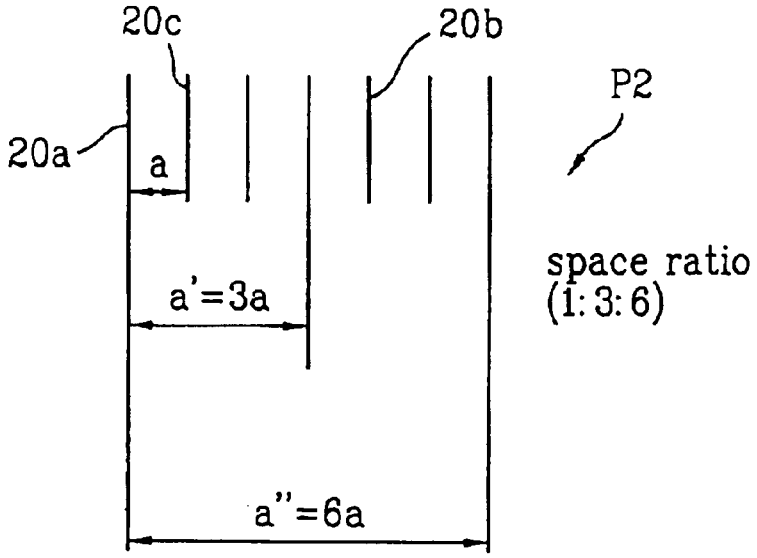
Figure 11:
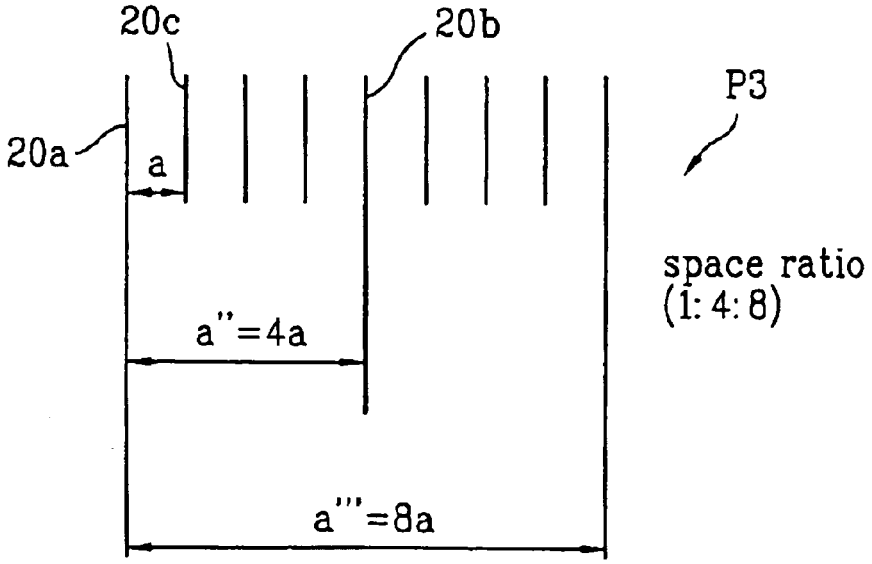
Figure 12A:
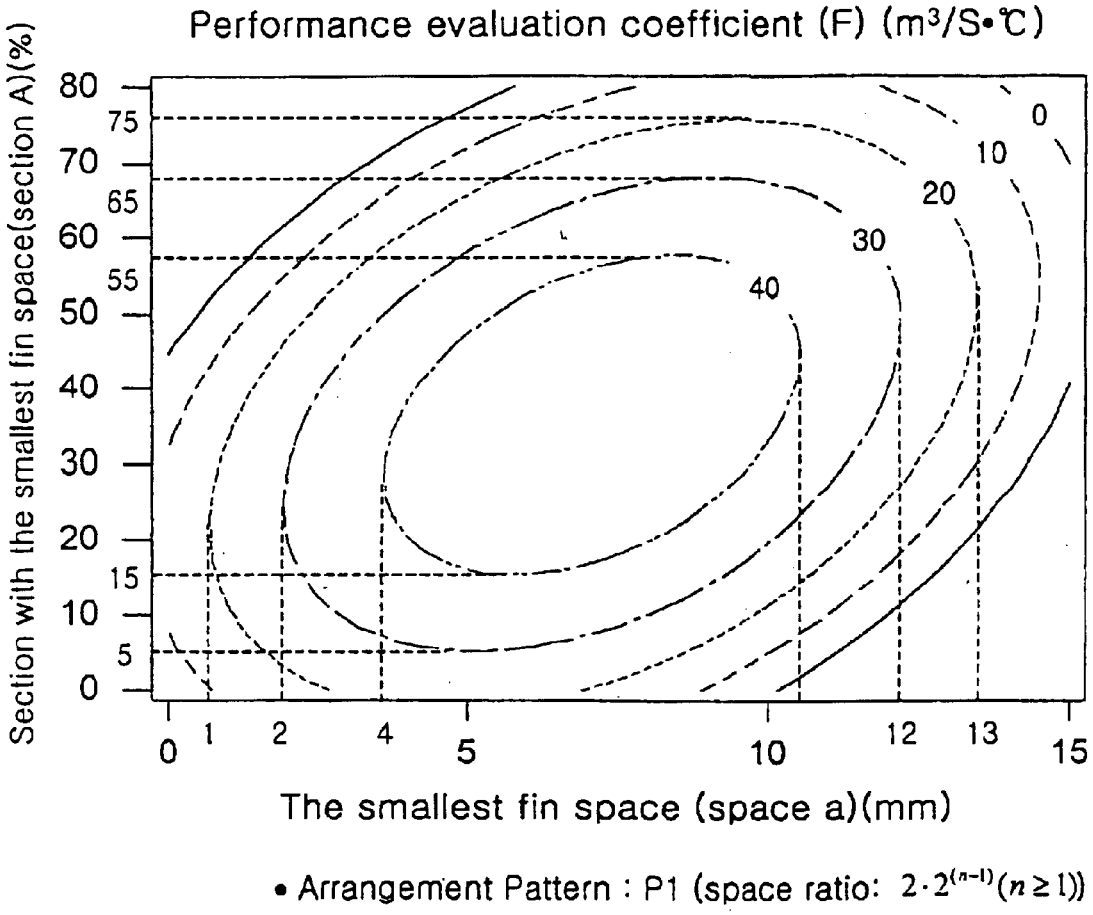
Figure 12B:
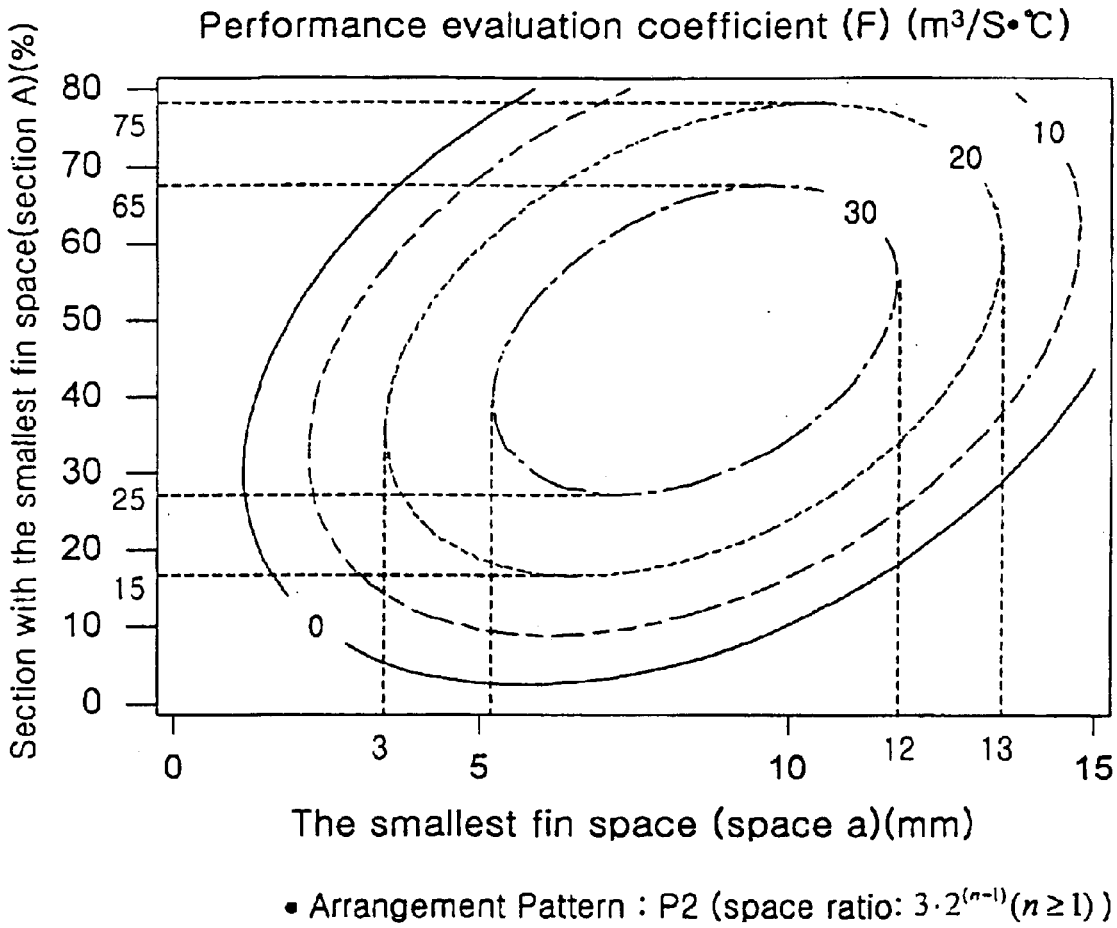
Figure 12C:
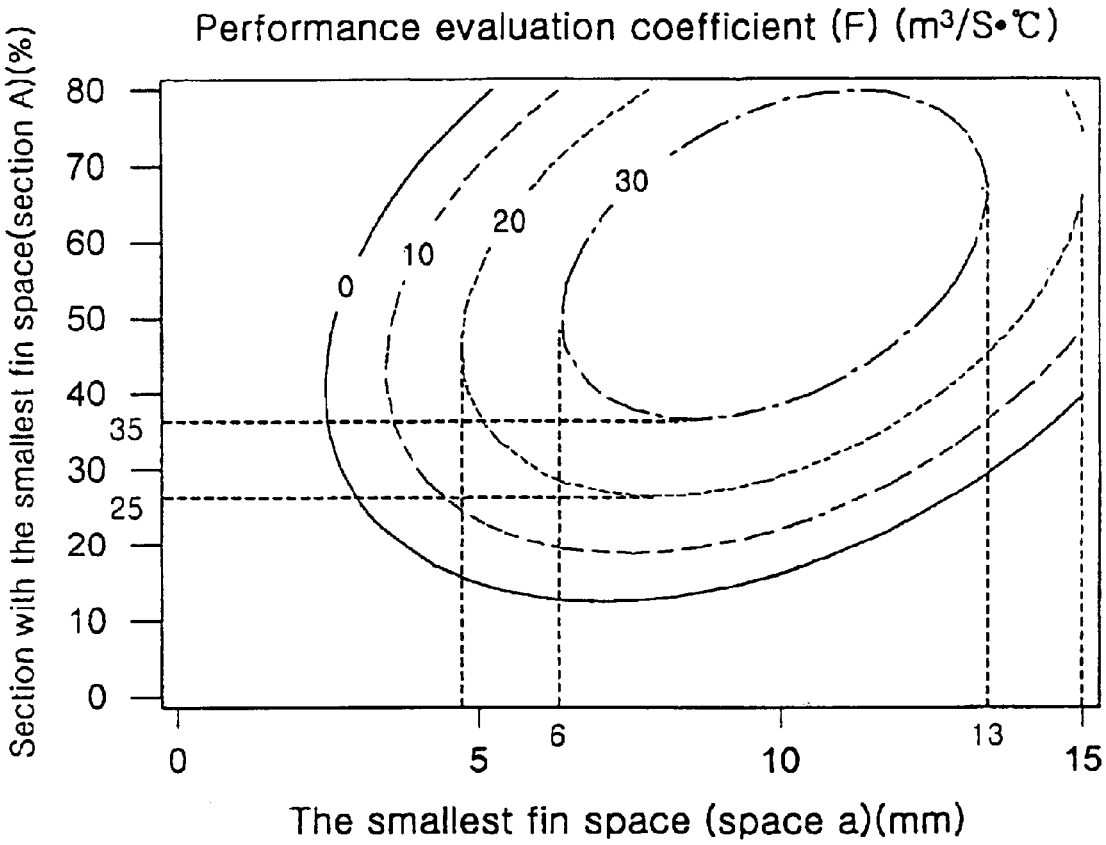
Figure 13:
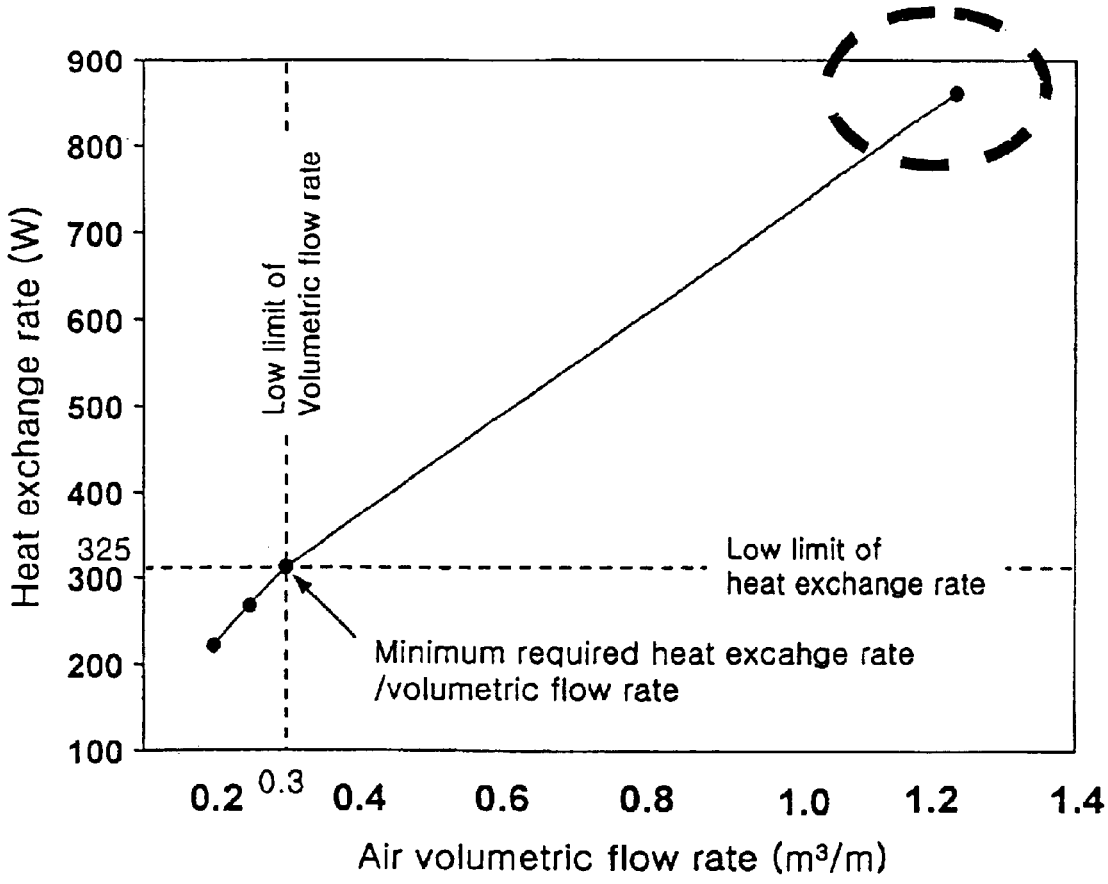
Figure 14:
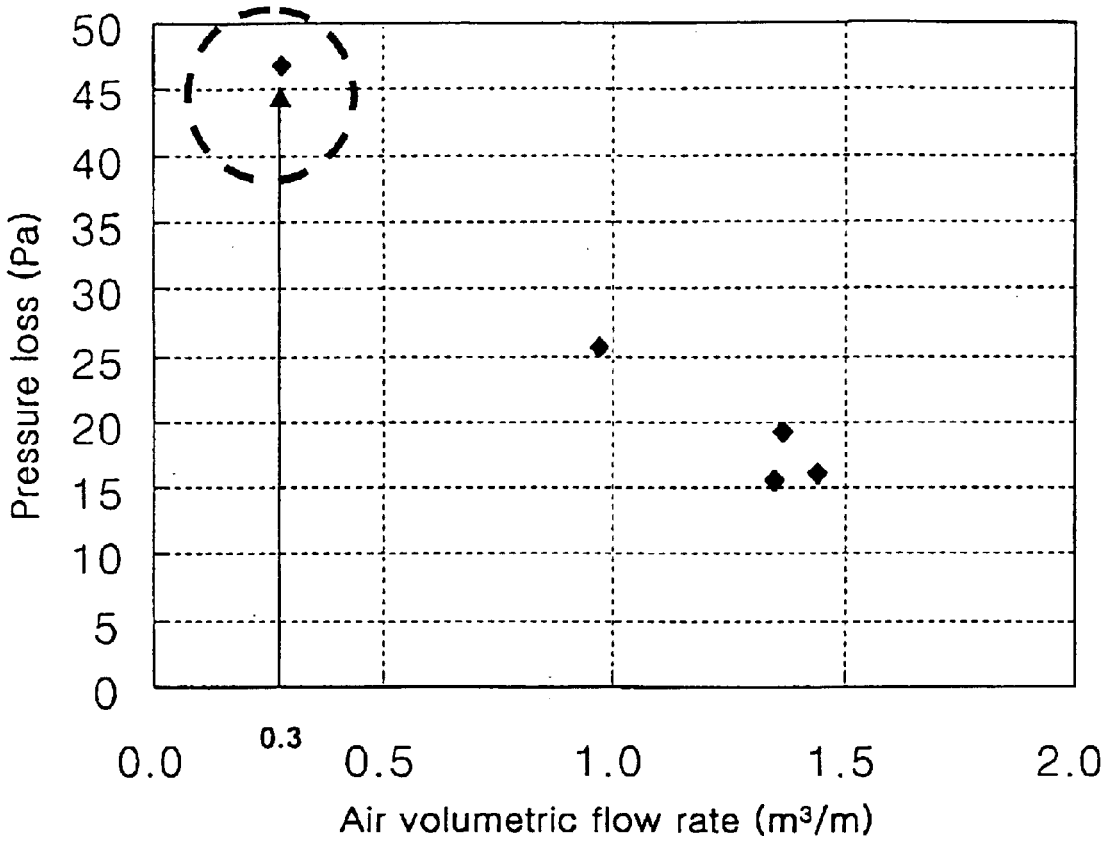
Figure 15A:
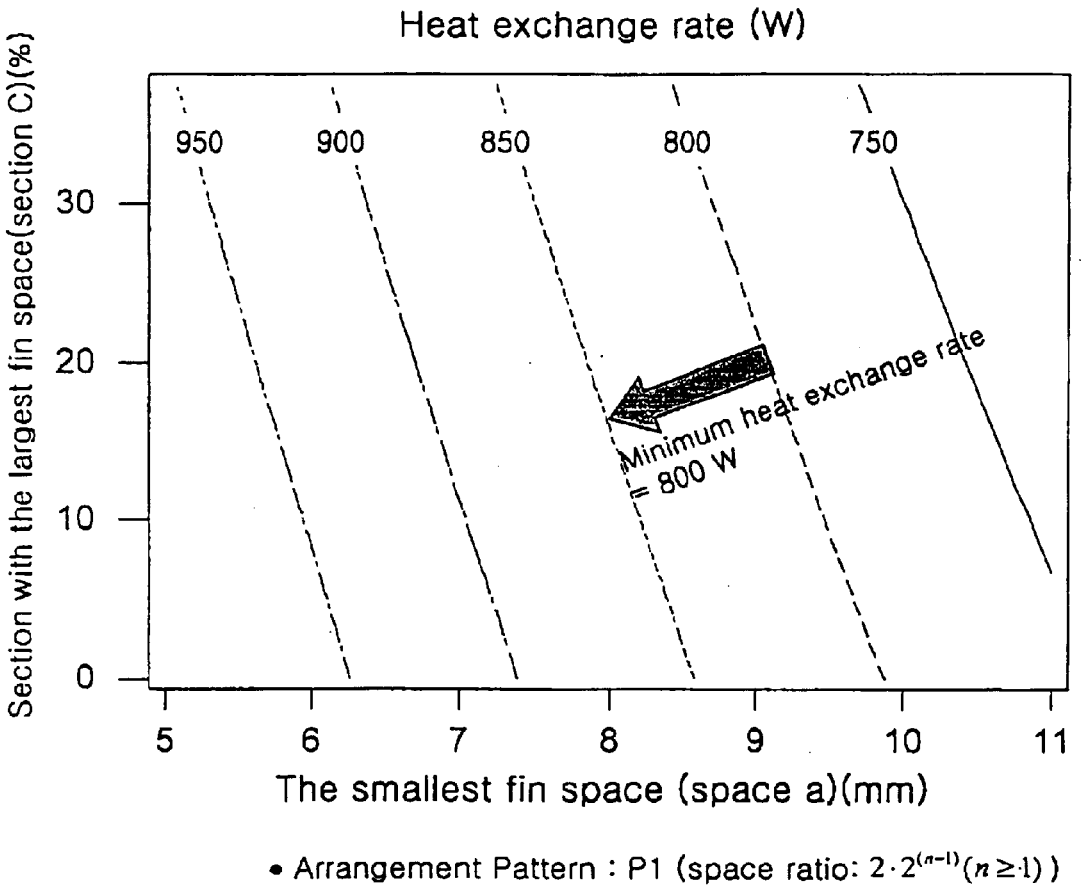
Figure 15B:
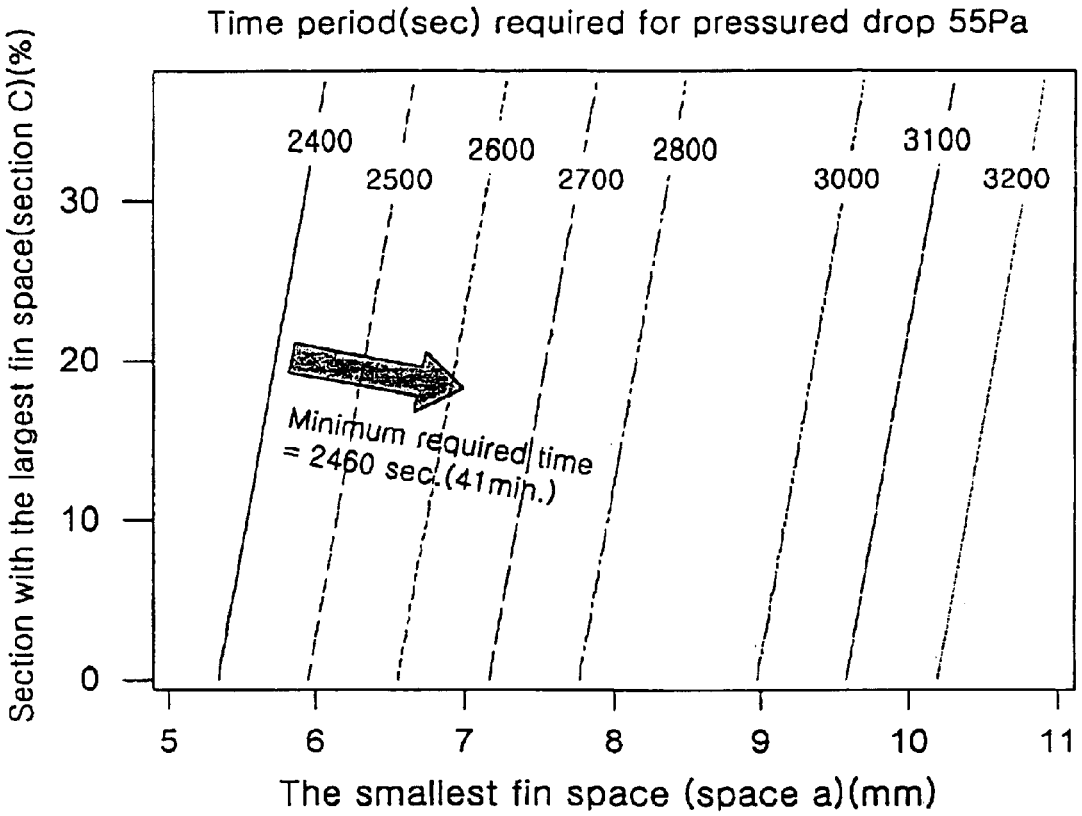
Figure 15C:
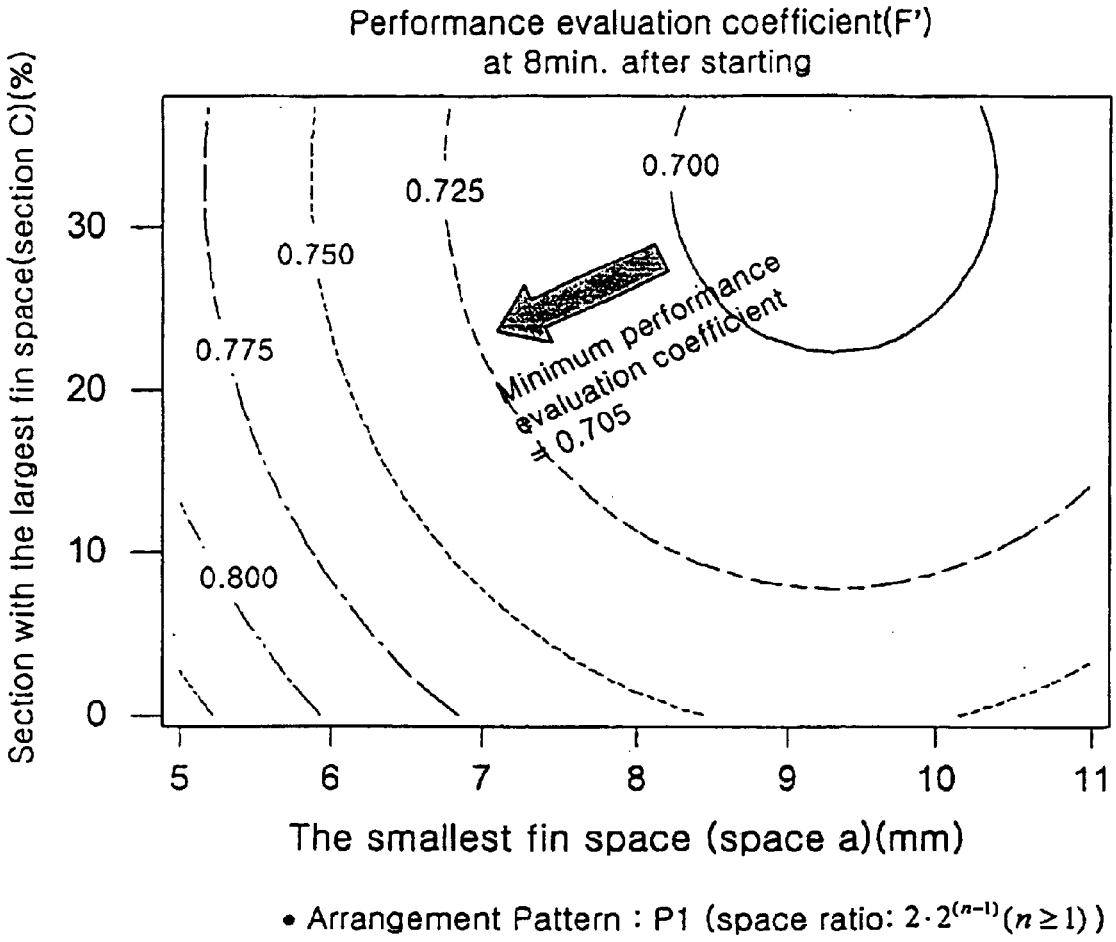
Figure 16:
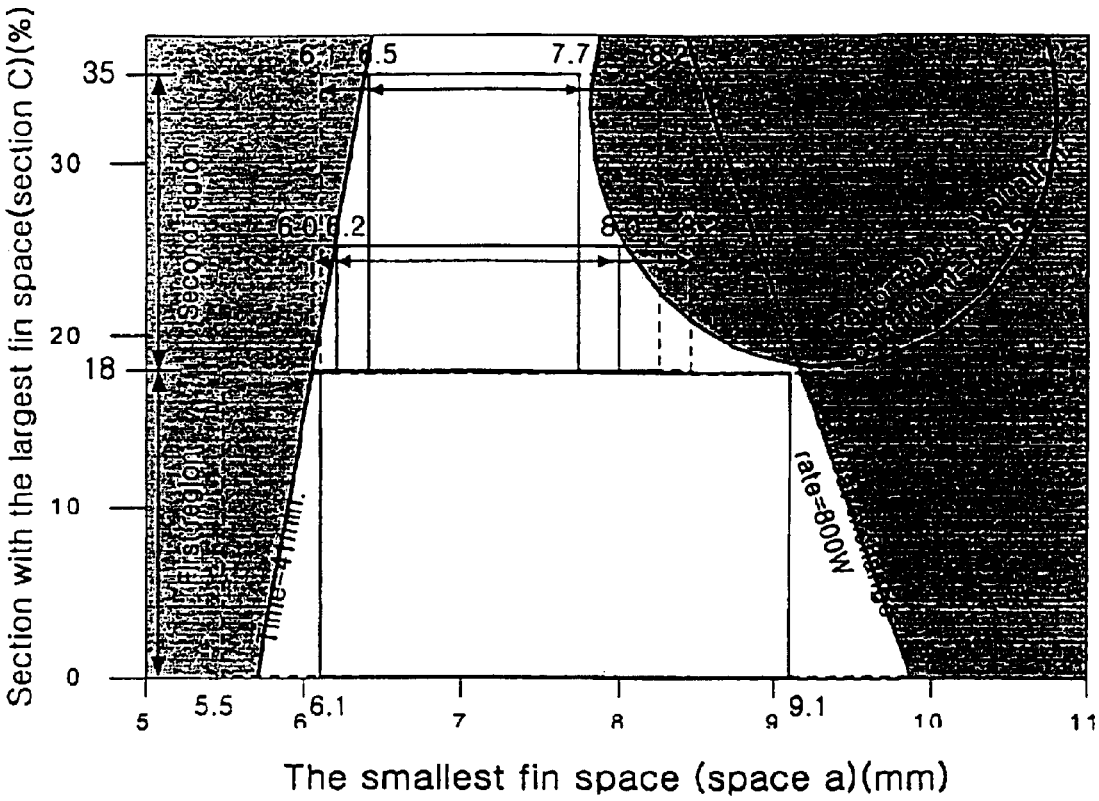
Figure 17:
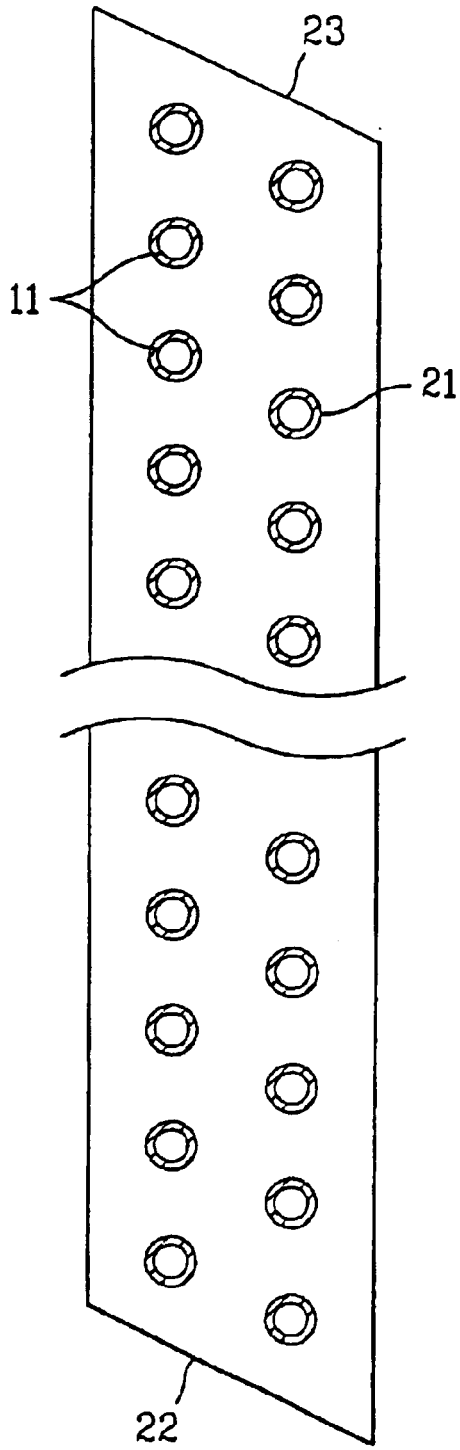
Figure 18A:
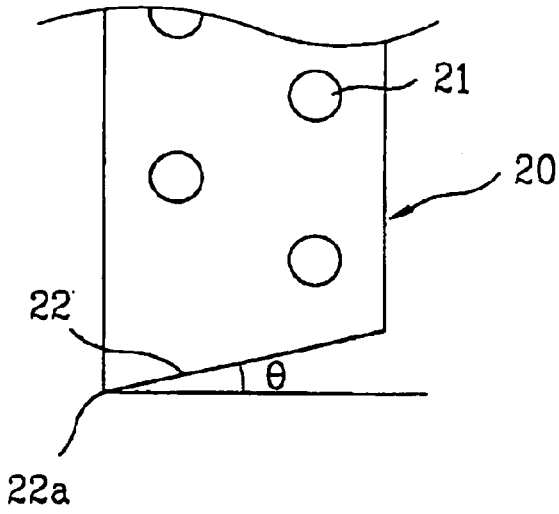
Figure 18B:
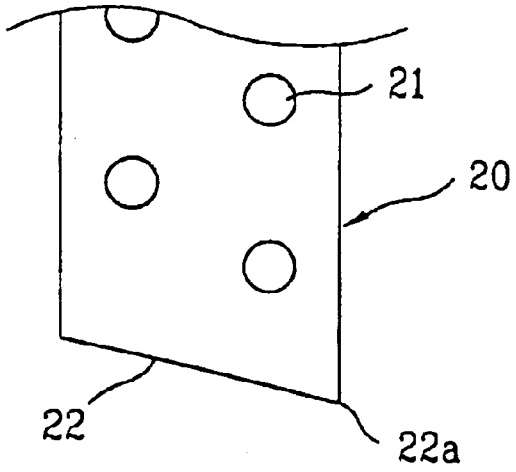
Figure 19A:
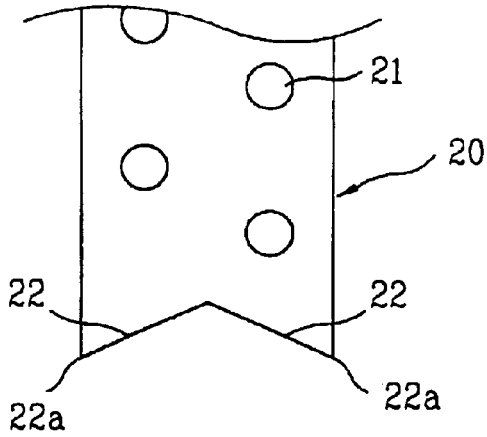
Figure 19B:
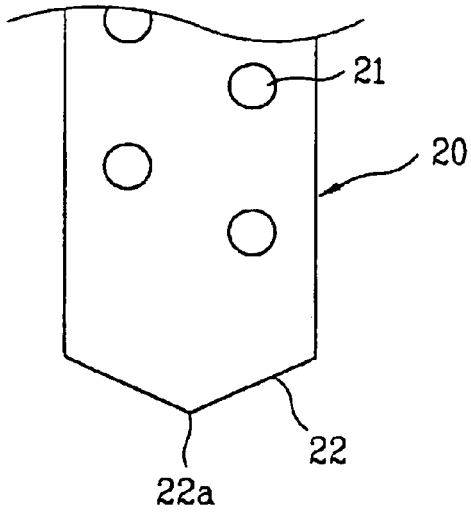
Figure 19C:
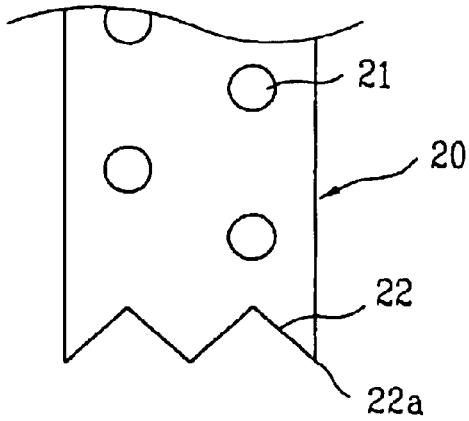
Figure 20A:
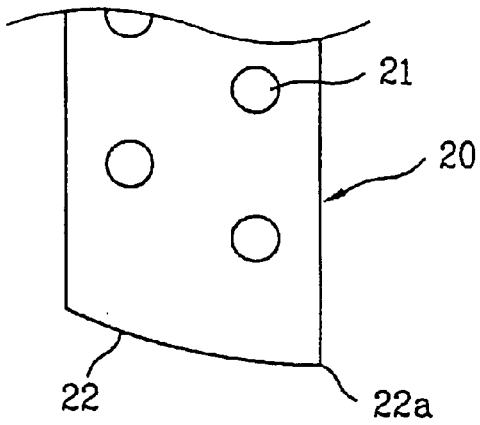
Figure 20B:
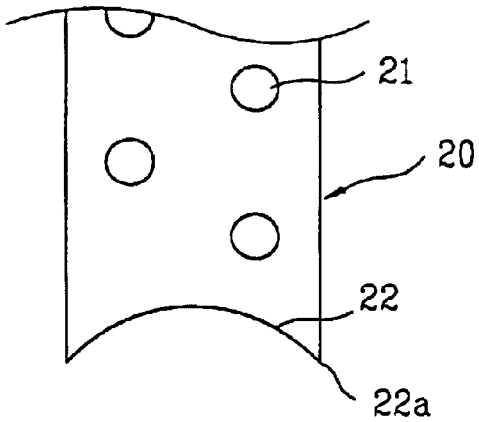
Figure 20C:
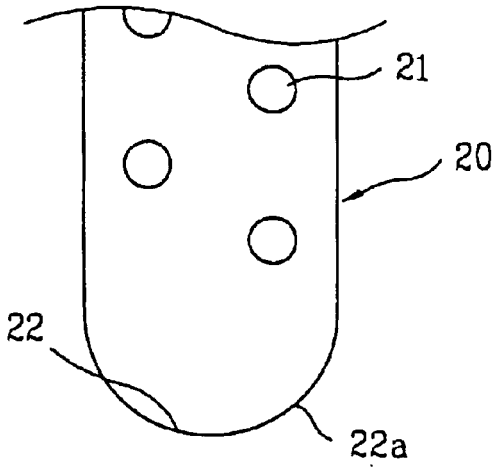
Figure 20D:
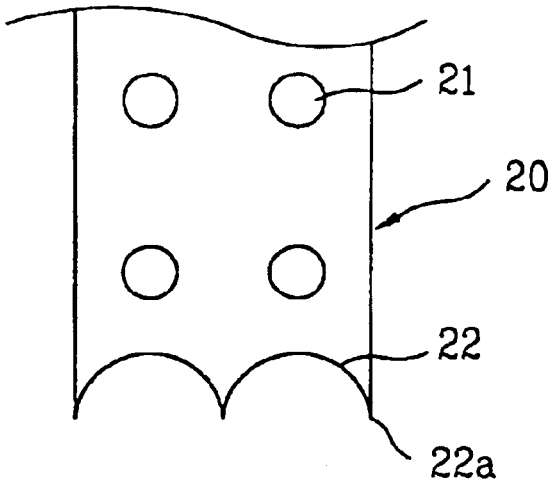
Figure 20E:
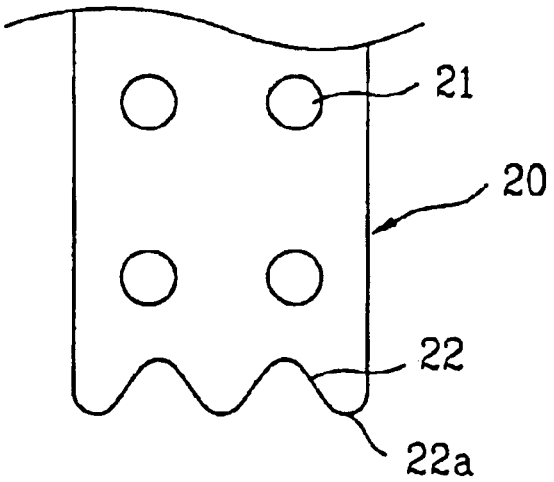
Figure 21A:
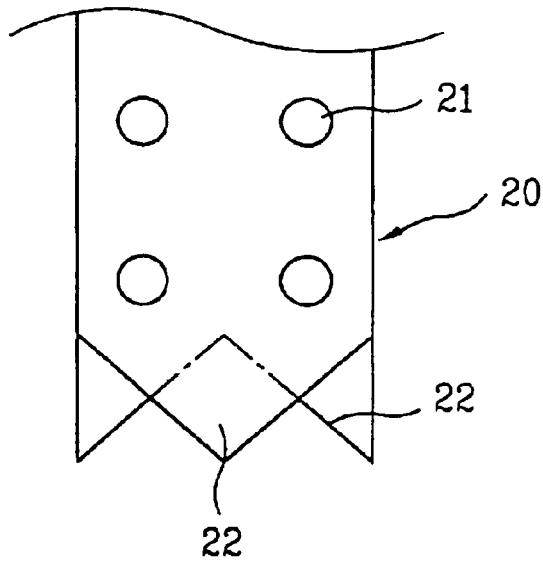
Figure 21B:
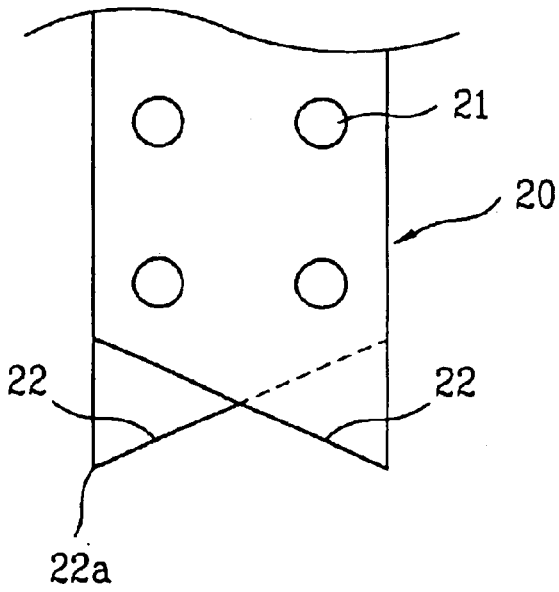
Figure 22:
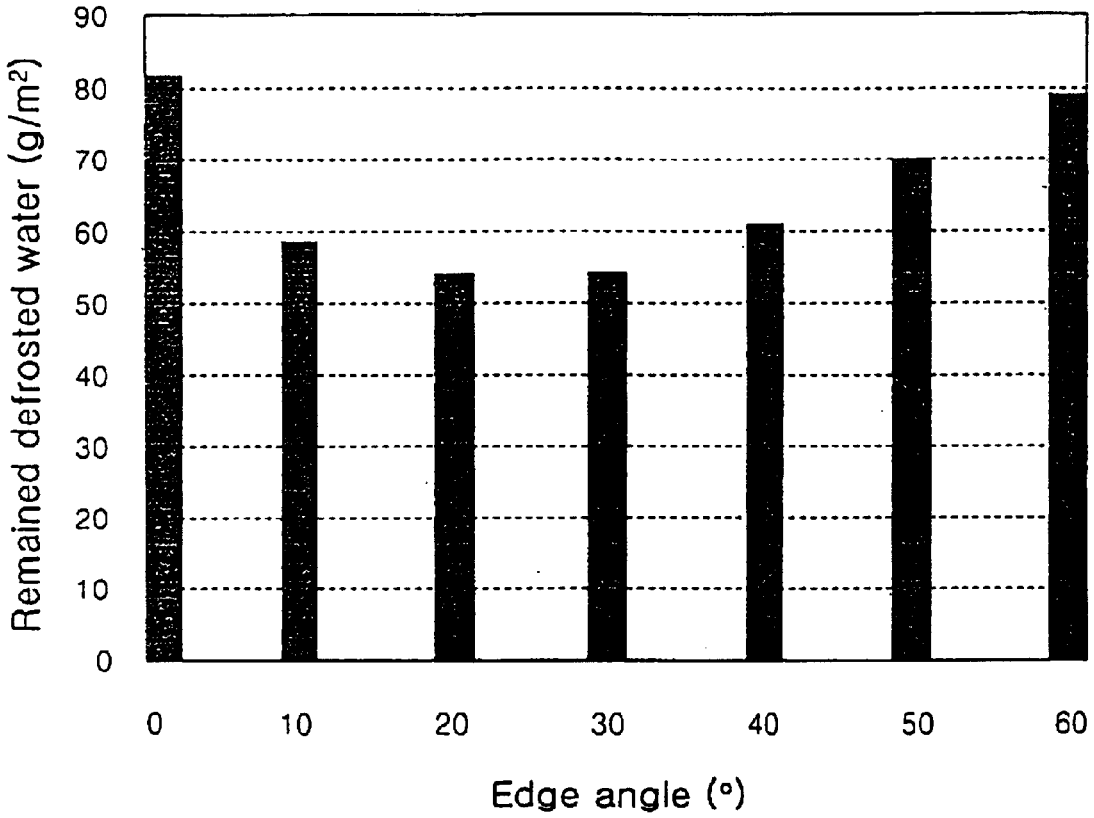
Figure 23:
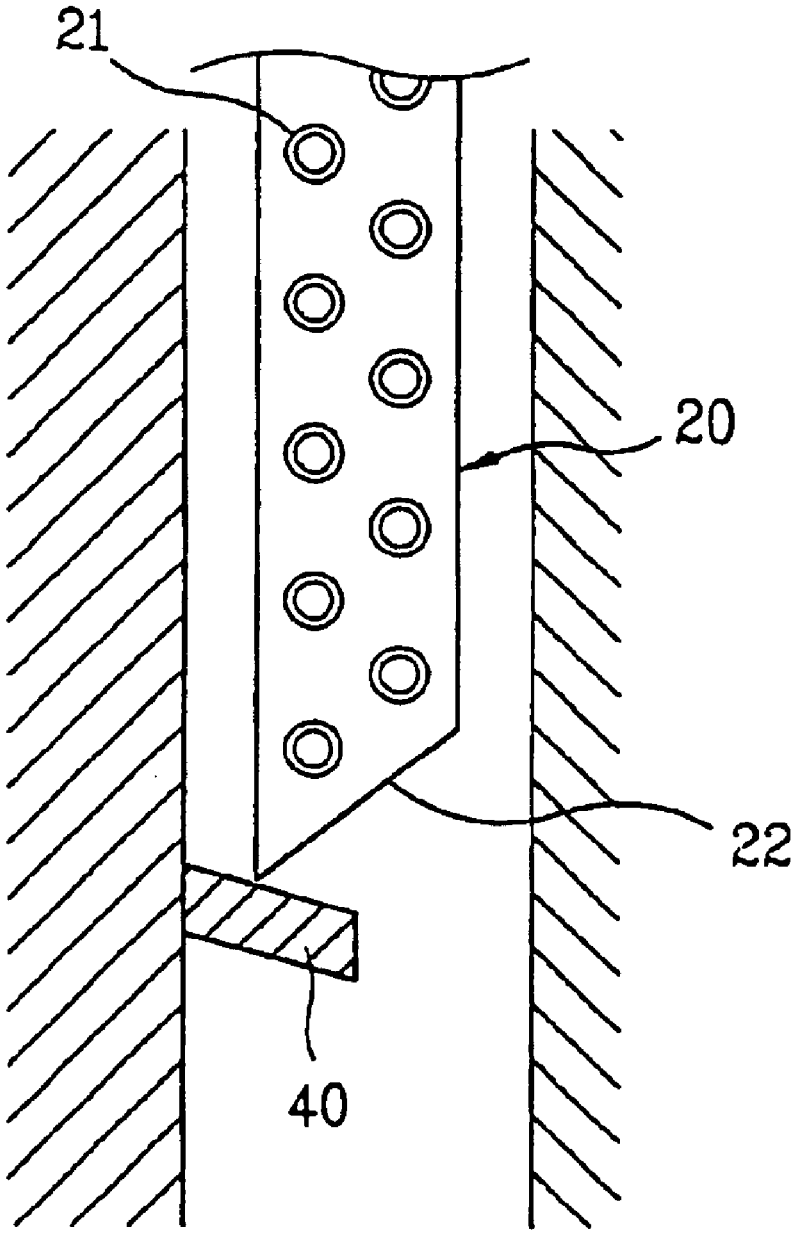
Figure 24:
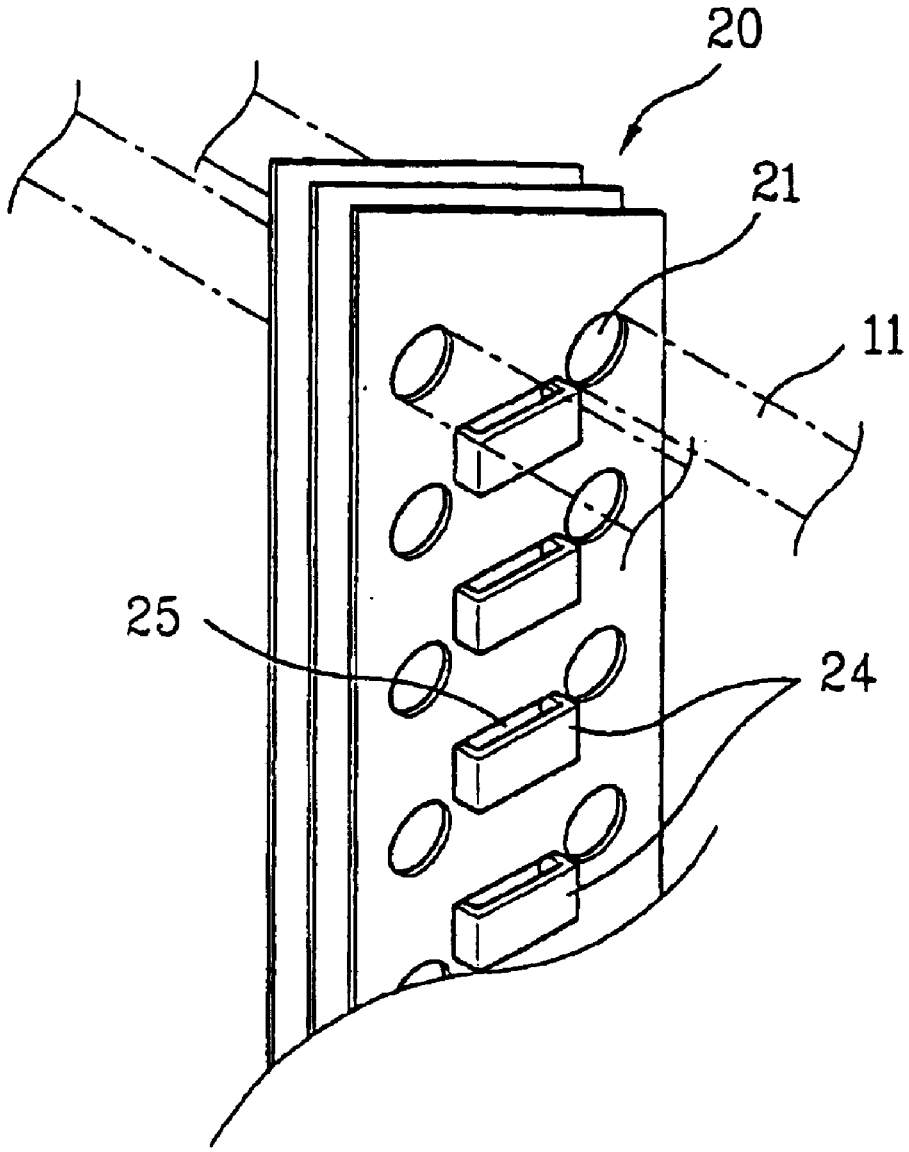
Figure 25A:
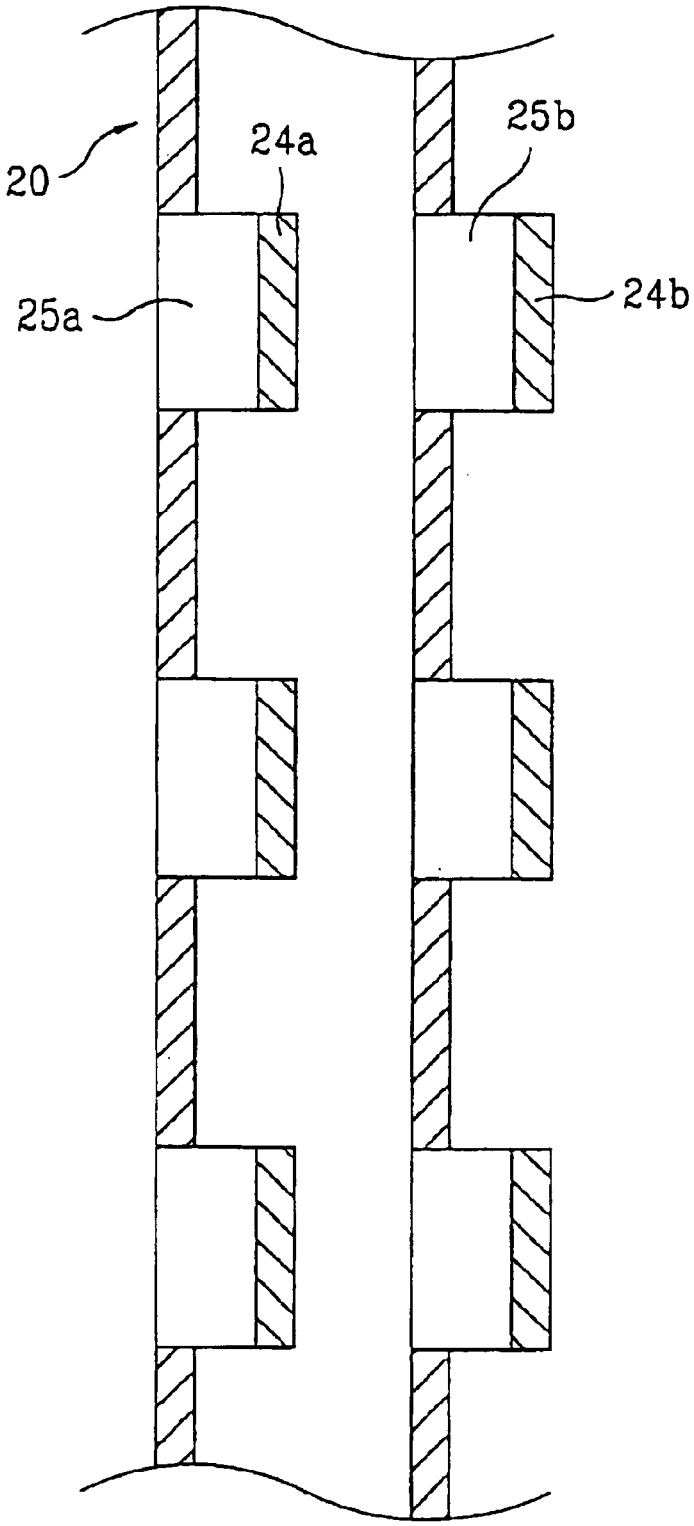
Figure 25B:
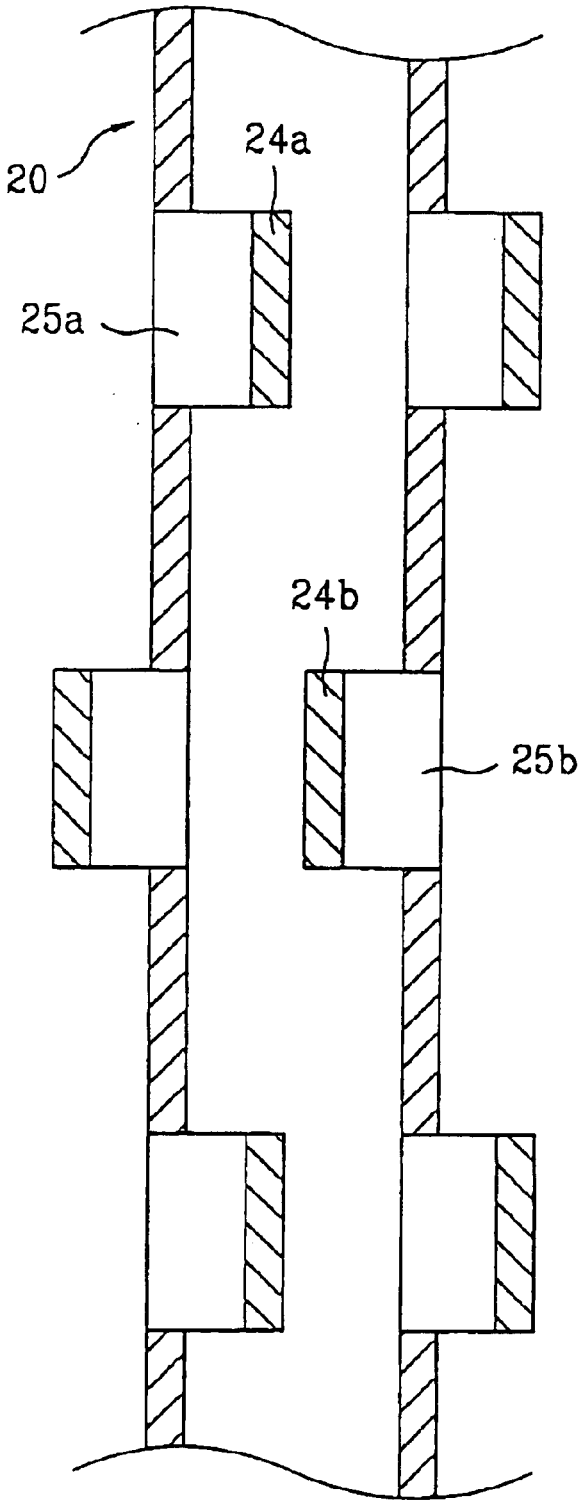
Figure 26:
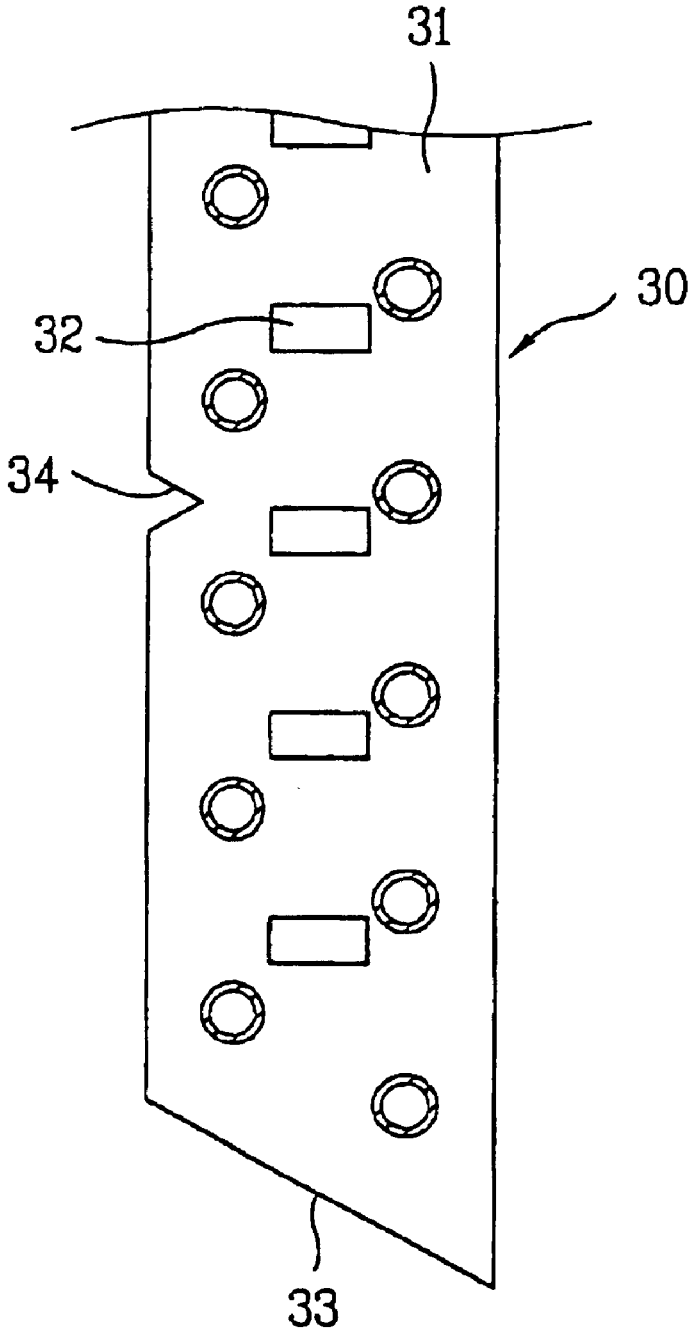
Figure 27A:
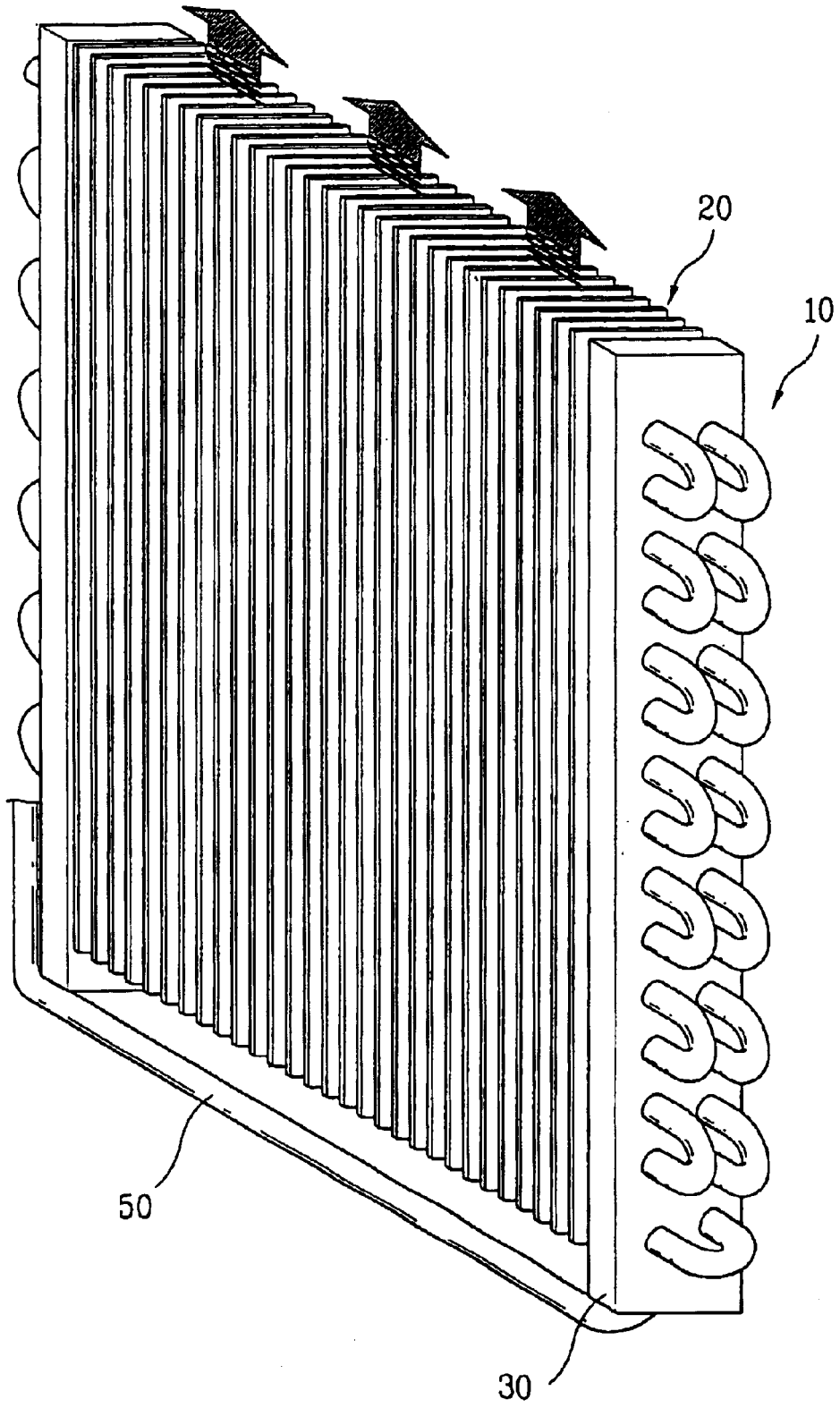
Figure 27B:
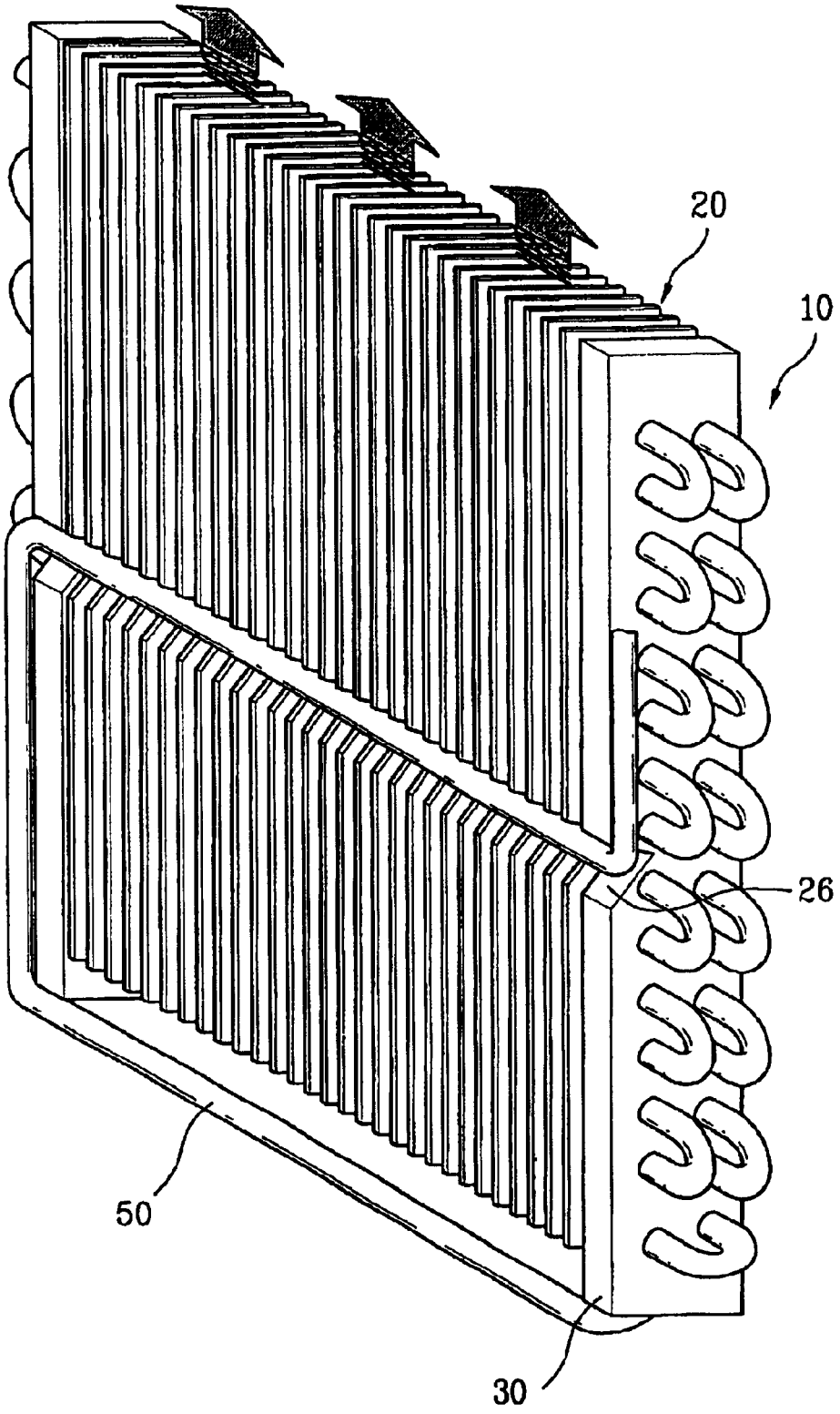

FIG. 10 illustrates a fin arrangement pattern in accordance with another preferred embodiment of the present invention, schematically;

FIG. 11 illustrates a fin arrangement pattern in accordance with another preferred embodiment of the present invention, schematically;

FIG. 12A illustrates a graph showing a performance evaluation coefficient vs. a smallest fin space and a ratio of a section the fin space is the smallest when an arrangement pattern is P1 type;

FIG. 12B illustrates a graph showing a performance evaluation coefficient vs. a smallest fin space and a ratio of a section the fin space is the smallest when an arrangement pattern in P2 type;

FIG. 12C illustrates a graph showing a performance evaluation coefficient vs. a smallest fin space and a ratio of a section the fin space is the smallest when an arrangement pattern is P3 type;

FIG. 13 illustrates a graph showing a heat exchange rate vs. a volumetric flow rate of air during operation of a refrigerator;

FIG. 14 illustrates a graph showing a pressure loss vs. a volumetric flow rate of air during operation of a refrigerator;

FIG. 15A illustrates a graph showing a heat exchange rate vs. a ratio of a section of the smallest fin space to a section of the largest fin space;

FIG. 15B illustrates a graph showing a time period for a 55 Pa pressure drop vs. a ratio of a section of the smallest fin space to a section of the largest fin space;

FIG. 15C illustrates a graph showing a performance evaluation coefficient 8 min. after starting vs. a ratio of a section of the smallest fin space to a section of the largest fin space;

FIG. 16 illustrates a graph showing results of FIGS. 15A–15C put together vs. a ratio of a section of the smallest fin space to a section of the largest fin space;

FIG. 17 illustrates a plan view of a fin having sloped top and bottom in accordance with a preferred embodiment of the present invention;

FIGS. 18A and 18B illustrate plan views of bottom edges of fins each with a single slope;

FIGS. 19A–19C illustrate plan views of bottom edges of fins each with multiple slopes;

FIGS. 20A–20E illustrate plan views showing variations of the bottom edges of fins in FIGS. 18A–19E;

FIGS. 21A and 21B illustrate plan views showing arrangement patterns of bottom edges in accordance with preferred embodiment of the present invention;

FIG. 22 illustrates a graph showing an amount of remained defrosted water vs. a slope angle of the bottom edge;

FIG. 23 illustrates a side view of a sloped member fitted to a fin bottom edge;

FIG. 24 illustrates a perspective view of a fin with slits and louvers in accordance with a preferred embodiment of the present invention;

FIGS. 25A and 25B illustrate sections each showing an arrangement pattern of slits and louvers in accordance with a preferred embodiment of the present invention;

FIG. 26 illustrates a front views of a reinforcing plate of a heat exchanger in accordance with a preferred embodiment of the present invention; and FIGS. 27A and 27B illustrate perspective views showing embodiments of mounting form of defrosters.

BEST MODE FOR CARRYING OUT THE INVENTION

Reference will now be made in detail to the preferred embodiments of the present invention, examples of which are illustrated in the accompanying drawings. In explaining the present invention, identical parts will be given the same names and reference symbols, and iterative explanation of which will be omitted.

Figure 1:
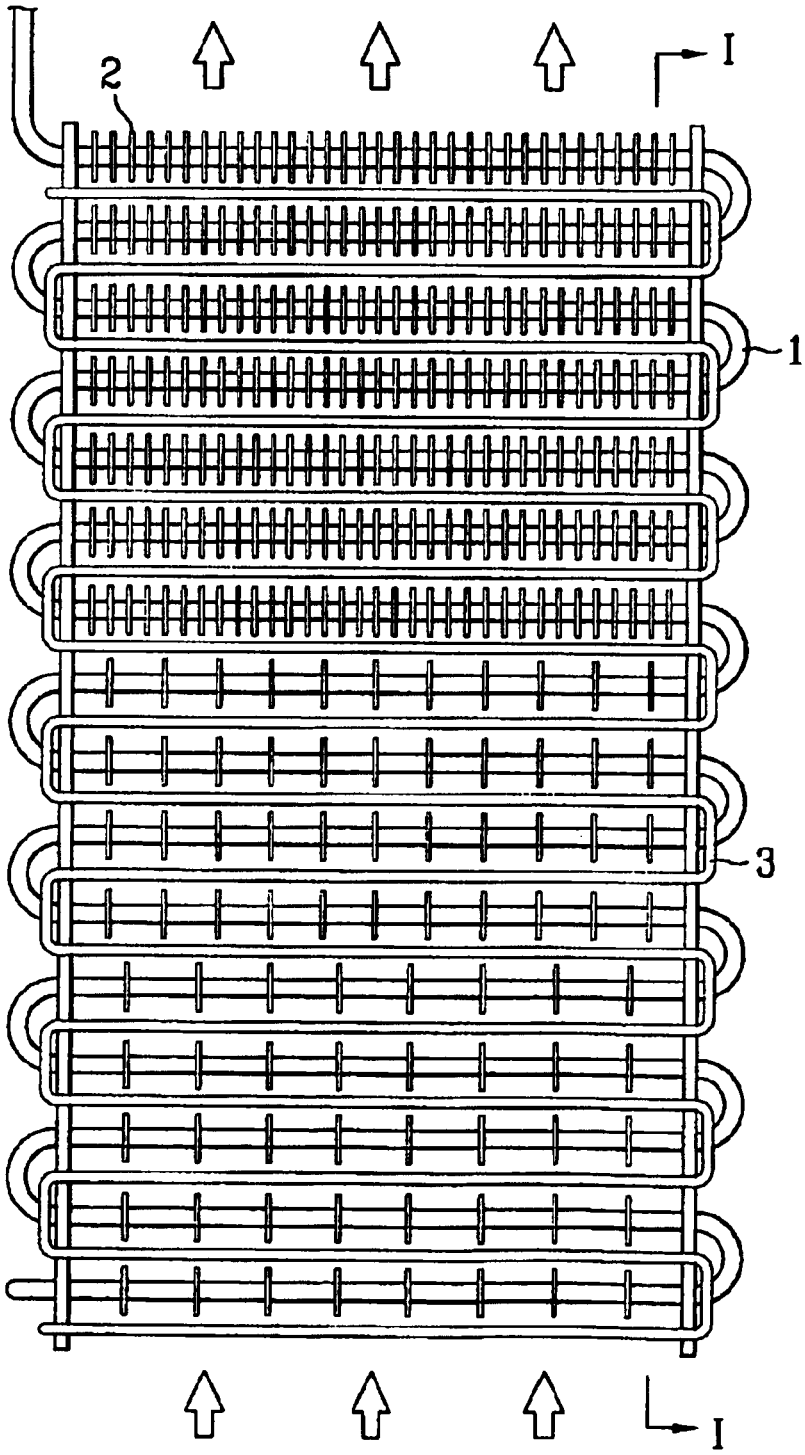
FIG. 1 PRIOR ART
Figure 2:
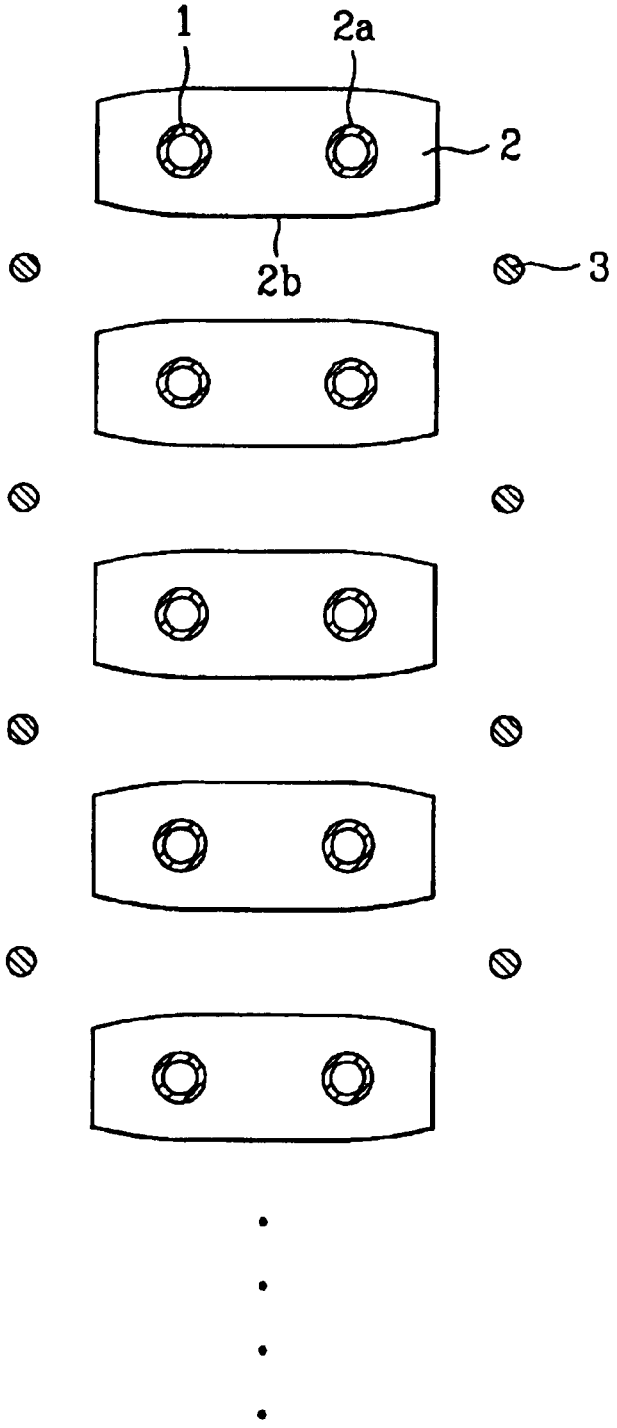
FIG. 2 PRIOR ART
Figure 3A:
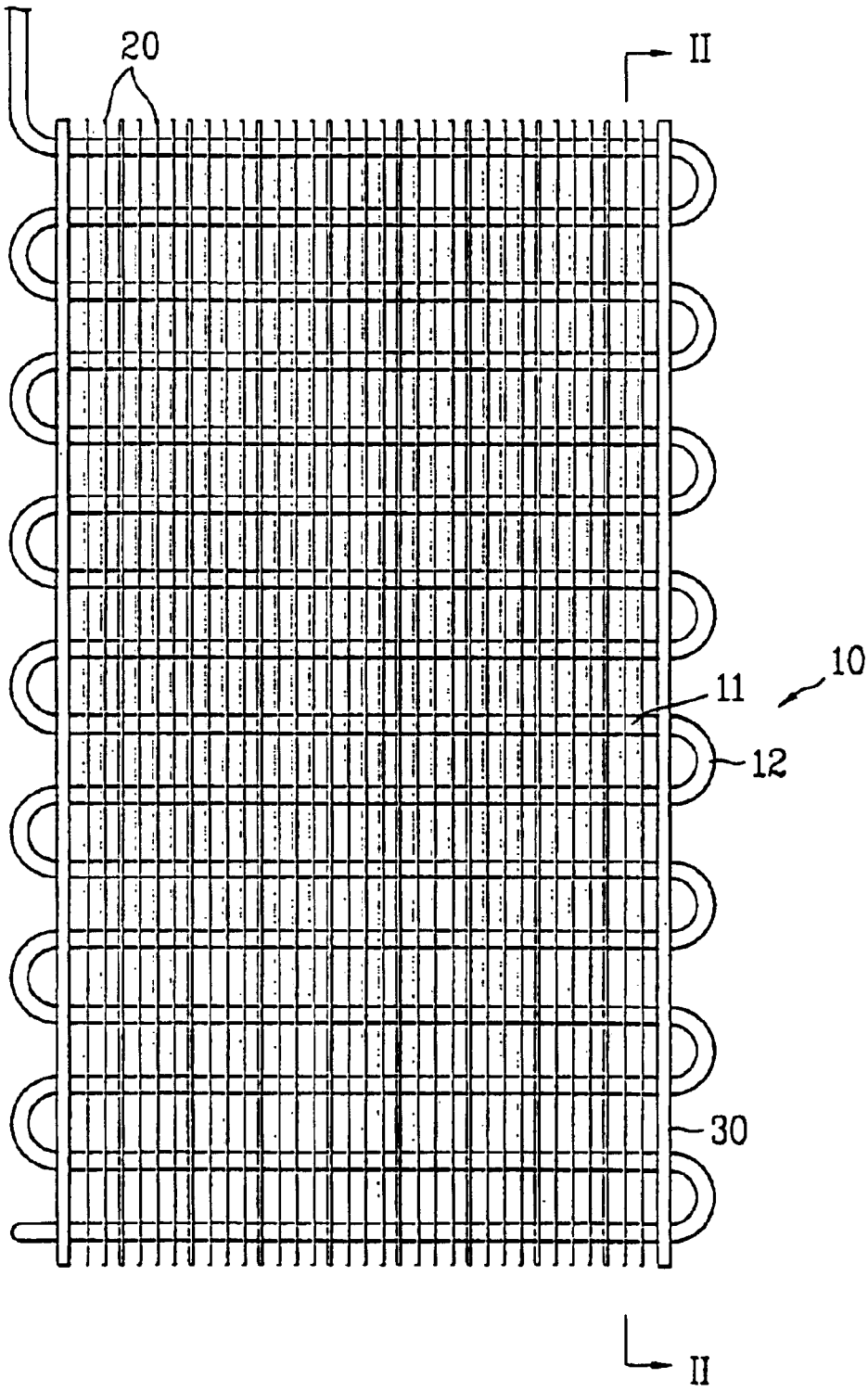
Figure 3B:
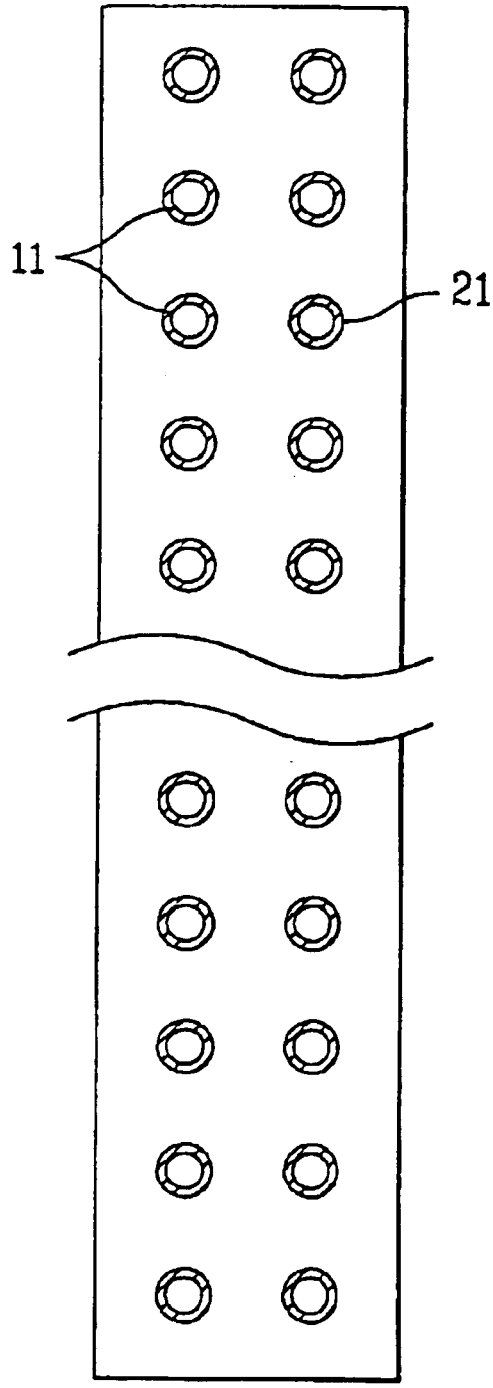

FIG. 3A illustrates a front view of a heat exchanger for a refrigerator in accordance with a preferred embodiment of the present invention, and FIG. 3B illustrates a side sectional view across a line II—II in FIG. 3A, referring to which a structure of the present invention will be explained, in detail.

The heat exchanger of the present invention includes one or more than one refrigerant tubes 10 for forming flow passages of the refrigerant supplied to a condenser, and a plurality of fins 20 coupled to the refrigerant tubes 10. The heat exchanger also has one pair of reinforcing plates 30 fitted to opposite sides of the fins 20.

Figure 4A:
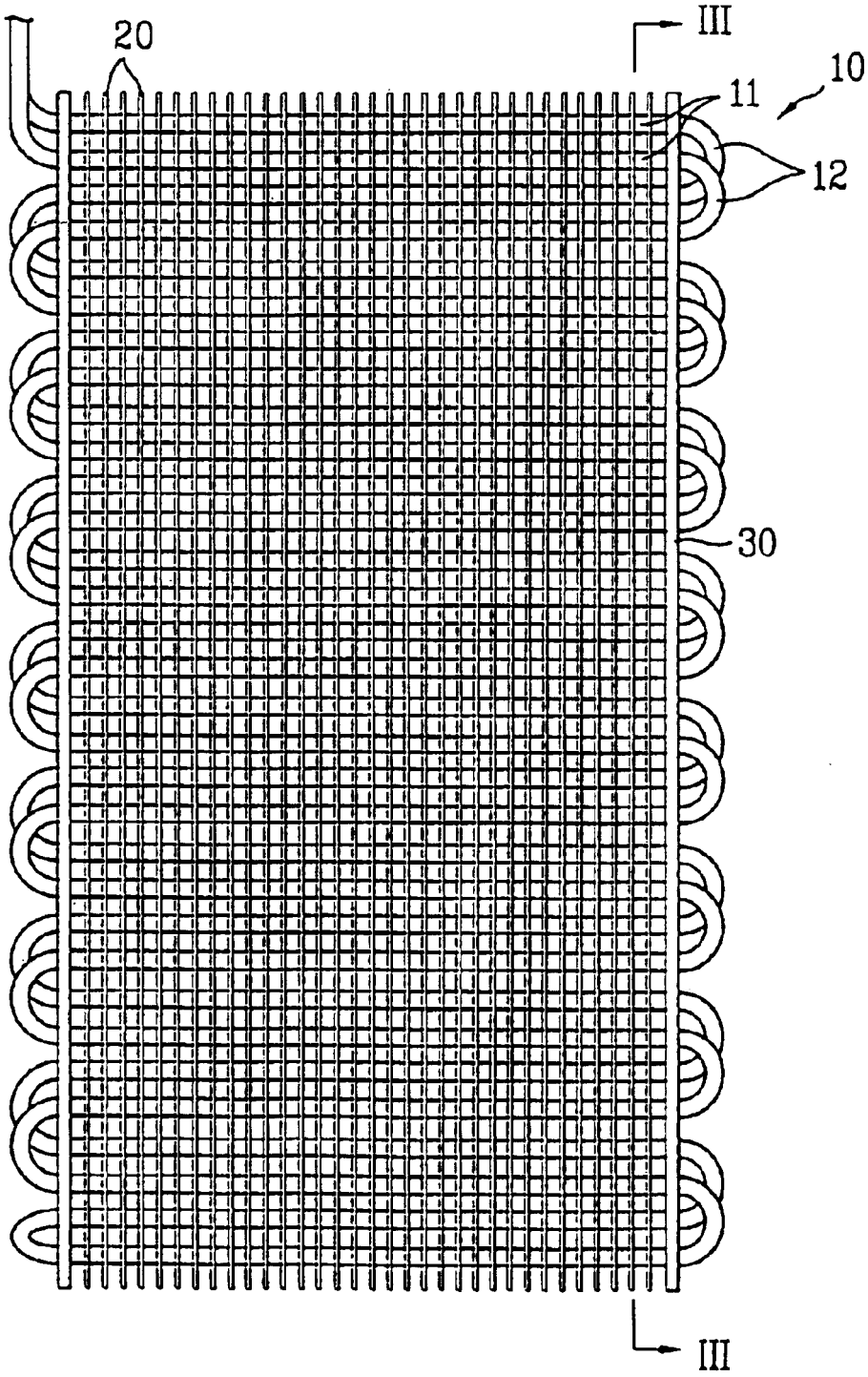
Figure 4B:
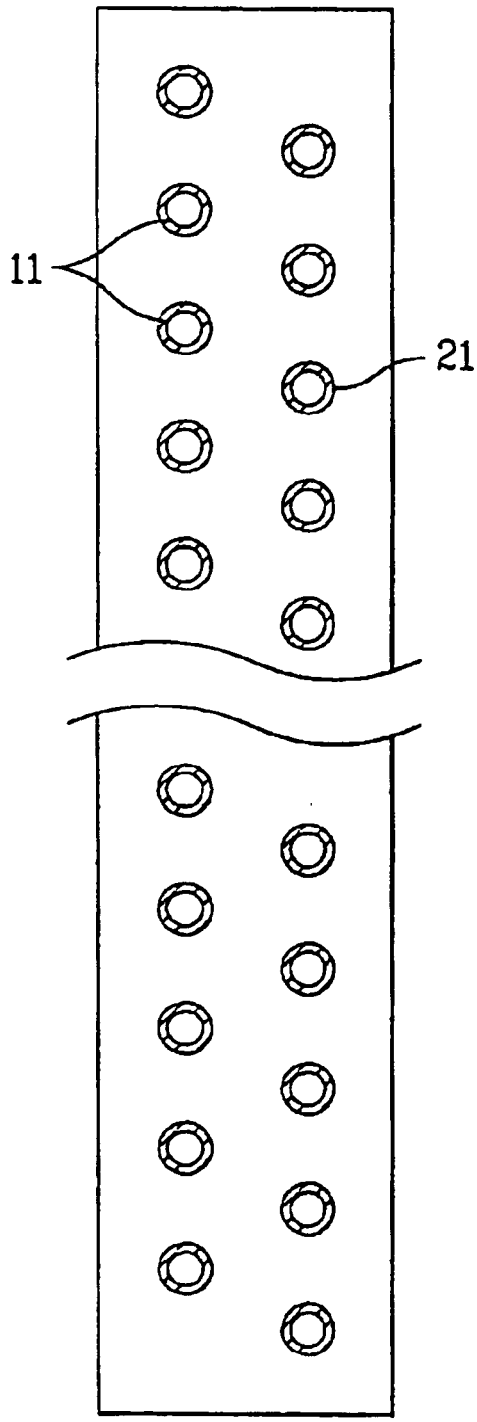

Each of the refrigerating tubes includes a plurality of straight parts 11 spaced at fixed spaces, and a plurality of curved parts 12 connecting the straight parts 11. The refrigerant tubes 10, more specifically, the straight parts 11, are arranged perpendicular to an air flow direction substantially, and as shown in FIG. 3B, one line of refrigerant tube forms one column in a length direction of the heat exchanger. As shown in FIGS. 3A and 3B, the straight parts 11 in different columns may be aligned parallel to each other. However, as shown in FIGS. 4A and 4B, for enhancing a performance of the heat exchanger, it is preferable that the straight parts 11 are arranged perpendicular to each other along with through holes 21 in the fin. The perpendicular arrangement prevents frost grown between tow refrigerant tubes from bridging to each other, thereby preventing an increased flow resistance.

The fin 20 is a flat straight plate with a fixed length, and has a plurality of through holes 21 on one or more columns in a length direction of the fin 20 for coupling with the refrigerant tube 10. In more detail, as shown in FIGS. 3B and 4*b*, the fin 20 of the present invention is coupled with the straight part 11 of the refrigerant tube 10 along a length direction of the straight part 11 at fixed spaces parallel to each other, to extend such that the straight parts 11 on the same column are connected in succession. Accordingly, the water (hereafter call as 'defrosted water') formed at the refrigerant tube 10 and the fins 20 during the defrosting is discharged along the fins 10 from the upper part to the lower part of the heat exchanger, smoothly. Moreover, the straight fin 20 of the present invention applied thereto permits to reduce the defrosted water remained by surface tension because the straight fin 20 has fewer number of the lower edges compared to the discrete fin.

Figure 5:
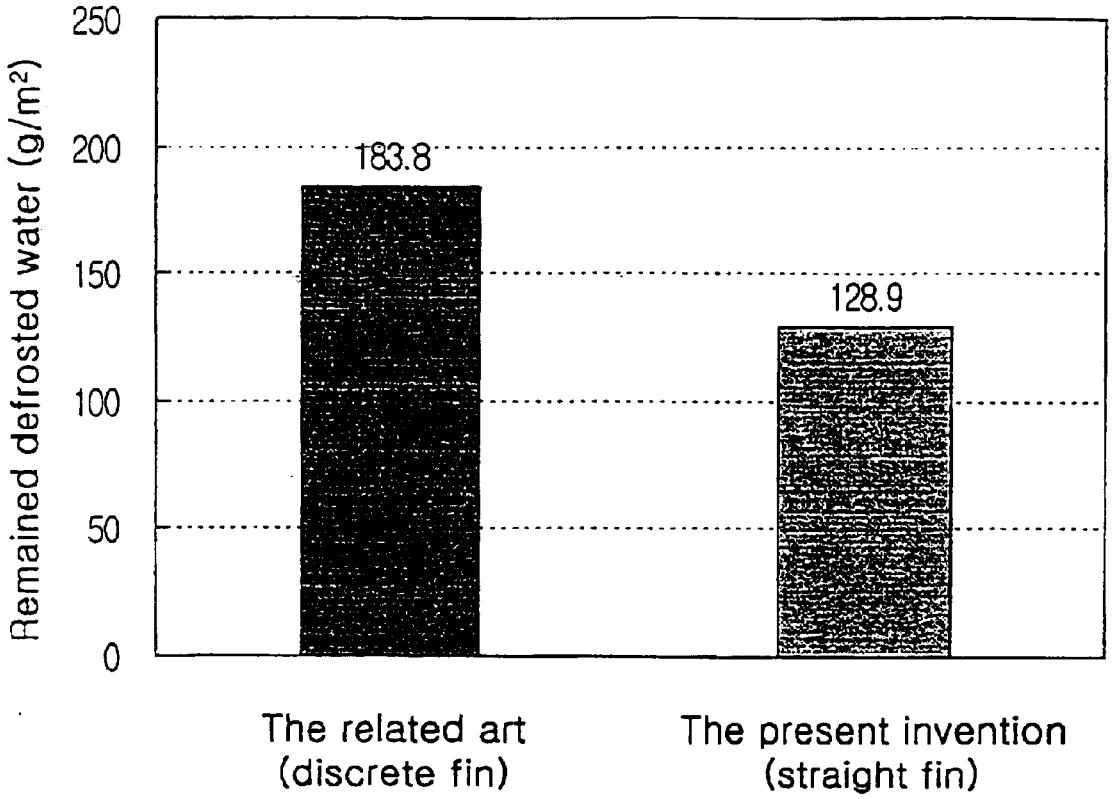

Such a tendency can be verified by an actual test. FIG. 5 illustrates a graph showing an amount of remained defrosted water per a unit area of fin of the related art or the present invention, wherein the discrete fin (the related art) and the straight fin (the present invention) are compared. The amounts of remained defrosted water are measured after a certain time period is passed from the starting of the defrosting. As shown in FIG. 5, while the straight fin has 128.0 $g/m^2$ of remained defrosted water, the discrete fin has 183.8 $g/m^2$ of remained defrosted water, greater than the straight fin. In more detail, the remained defrosted water of the straight fin is merely 70% of the discrete fin.

Figure 6:
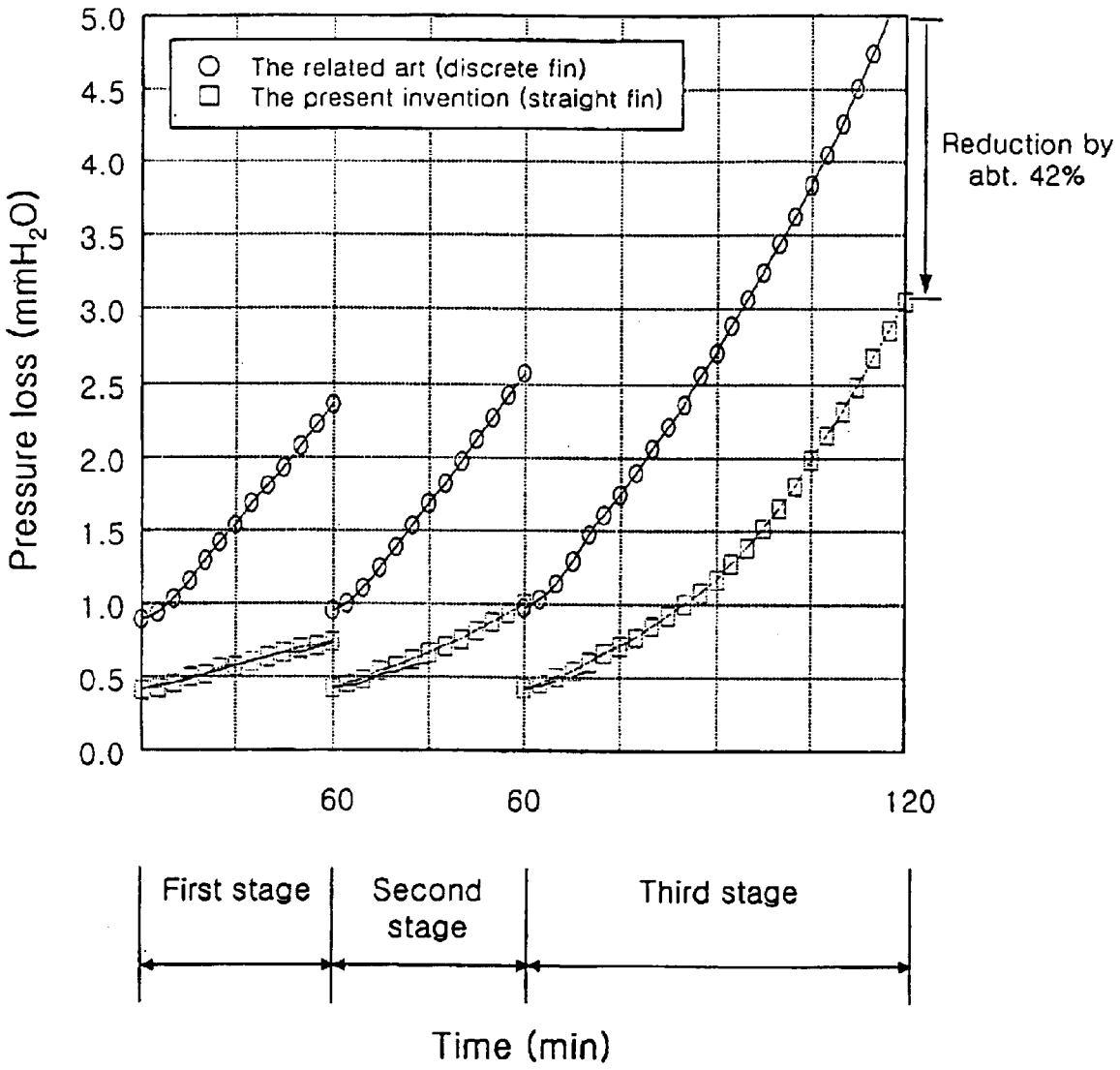

Moreover, such a reduction of remained defrosted water is related to a pressure loss of a heat exchanger directly, which is apparent from FIG. 6 illustrating the pressure loss vs. operation time period. In the test, identical to FIG. 5, heat exchangers having the discrete fins and the straight fins applied thereto are compared, wherein the pressure loss is a pressure difference between an air inlet (bottom of the heat exchanger) and an air outlet (a top of the heat exchanger). In a first stage, variation of a pressure loss is measured during 60 minutes of cooling operation of a dry heat exchanger, and, in a second stage, variation of a pressure is measured during 60 minutes of cooling operation again after a certain time period of defrosting in continuation from the first stage. Finally, in a third stage, variation of a pressure is measured during 120 minutes of cooling operation again after defrosting in continuation from the second stage. It can be noted from FIG. 6 that the pressure loss of the present invention is smaller than the related art in overall, and an increasing ratio of the pressure loss, represented with a slope of the graph, is smaller, too. Actually, the present invention has only approx. 42% of pressure loss of the related art at an end of in each of the stages, because of the small amount defrosted water, along with a reduced formation of frost and reduced increase ratio of the frost, that reduces the flow resistance. Together with this, the no substantial reduction of a heat transfer area during operation coming from the reduced formation of the frost permits no reduction of a heat exchange rate.

Moreover, since the straight fin 20 of the present invention has an effect the discrete fins are arranged in succession, the heat exchanger of the present invention can be formed at a size smaller compared to the heat exchanger of the discrete fins having the same heat transfer area applied thereto. By applying the straight fins 20, the heat exchanger of the present invention has simpler structure, and simpler fabrication process as the straight fin 20 can be coupled with the straight parts of the refrigerant tube on the same column at a time easily in assembly.

In conclusion, by applying the straight fins 20, the heat exchanger of the present invention is favorable compared to the related art heat exchanger having the discrete fins 20 in view of structure and performance.

In the meantime, moisture in air is brought into contact with a lower part of the heat exchanger at first on the way to the heat exchanger, and most of the moisture set on the lower part of the heat exchanger, i.e., on lower edges of the fins 20, accordingly. Therefore, as shown in FIG. 7, it is preferable that the fins 20 have lengths different from one another because it is liable that spaces between the fins 20 are clogged by the frost at the lower part of the fins 20, such that the fins 20 of different lengths are coupled to different number of the straight parts 11 of the refrigerating tube, and the bottom edges of fins 20 are positioned at different heights, so as not to oppose each other.

Along with this partial change of a form, the application of the fins 20 of different lengths causes the heat exchanger to have parts with fin 20 arrangement densities different from one another, in overall. In more detail, there are a section the fins 20 are the most densely arranged (section 'A') and a section the fins 20 are the most sparsely arranged (section 'C') in the heat exchanger. By adjusting the lengths and a sequence of the arrangement of the fins 20, there may be a section having, a middle fin density with respect to the section with a high fin density and the section with a low fin density. Moreover, a number of the 'B' section can also be adjusted.

Figure 7:
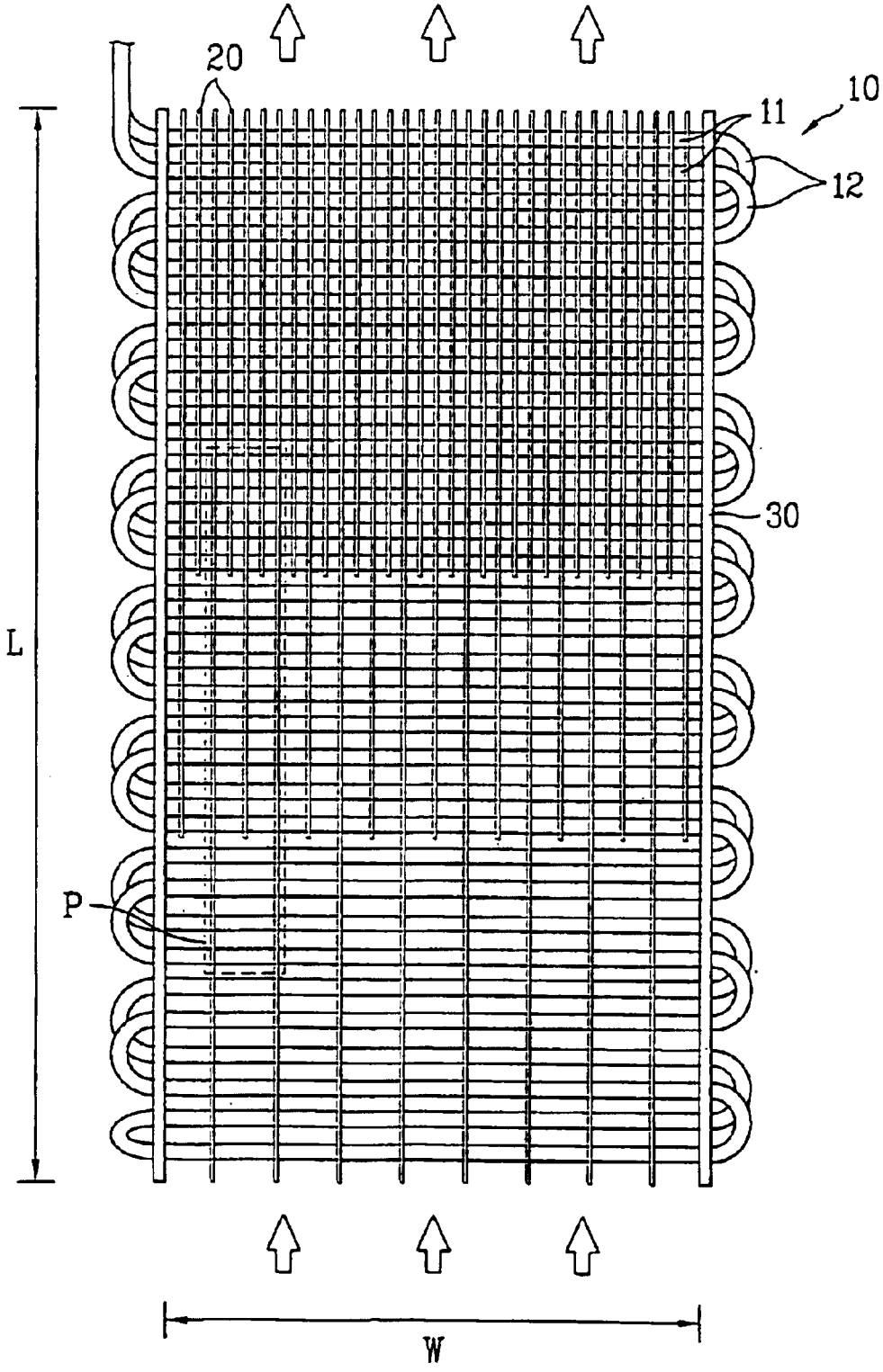
Figure 8:
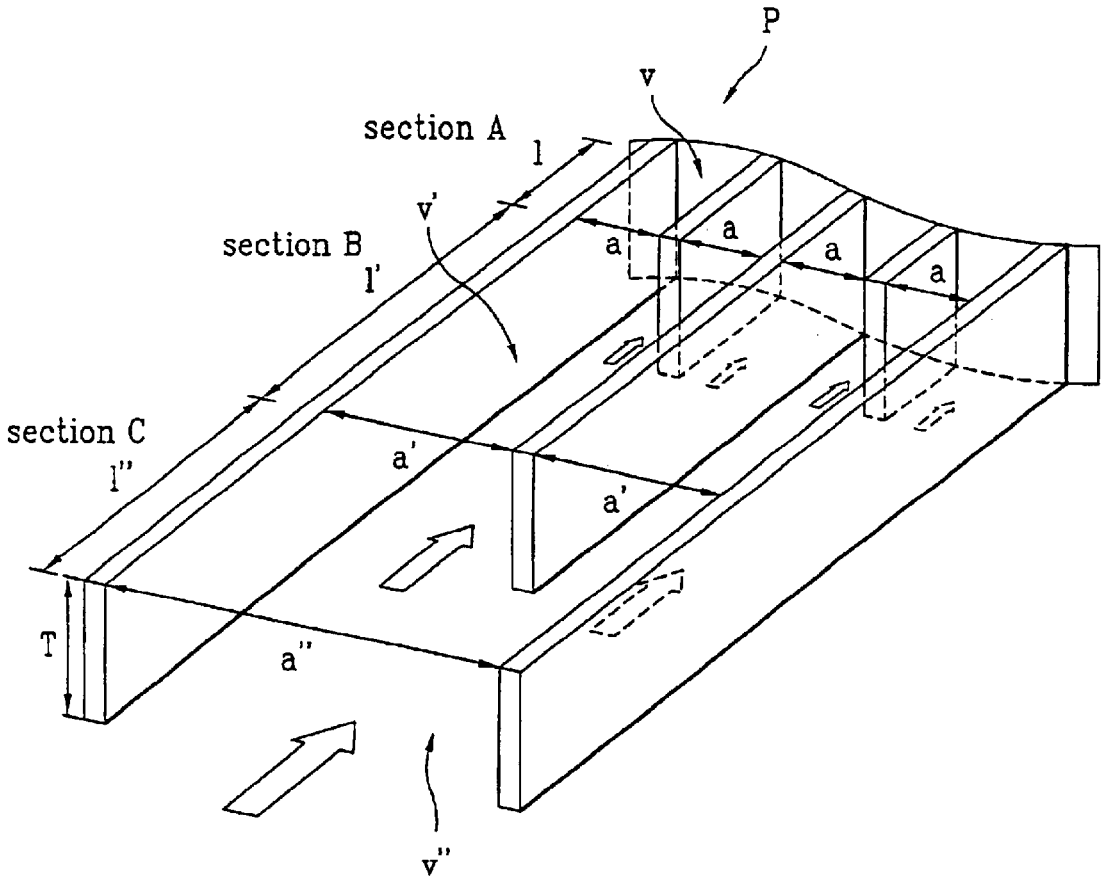

Variation of the fin density becomes more apparent when the fins 20 are arranged iteratively following a fixed pattern 'P' as shown in FIG. 7, rather than arranged irregularly. Moreover, as the variation of the fin arrangement density gives an influence to a performance of the heat exchanger inevitably, a regular fin arrangement pattern 'P' is favorable in prediction of a quantitative trend of the fin performance variation. Under this premise, FIG. 8 illustrates a perspective view of a part of a heat exchanger showing a fin arrangement pattern of FIG. 7 in a simplified form for showing characteristic parts only.

As shown, it can be noted that the variation of the fin arrangement density actually appears as a variation of air flow spaces individually formed between adjacent fins. The largest flow space 'V"' is formed between adjacent fins 20 in the section (section 'C') the fins 20 are the most sparse, and the smallest flow space 'V' is formed between adjacent fins 20 in the section (section 'A') the fins 20 are the most dense. Accordingly, the air introduced into the largest flow space 'V"' is split into smaller spaces 'V'' and 'V' in succession in flowing the spaces. As shown, the flow spaces 'V', 'V'', and 'V"' are defined by widths 'a', 'a'', and 'a"' and lengths 'l', 'l'', and 'l"' as the fins 20 have the same thickness. Therefore, the variation of the fin arrangement density can be characterized by the spaces 'a', 'a'', and 'a"' between adjacent fins 20 in view of geometry. That is, the section the fins are the most dense (section 'A') is the section the space between adjacent fins is the most small, and the section the fins are the most sparse (section 'C') is the section the space between adjacent fins is the most large. The lengths '1', 'l'', and '1"' represent sizes of respective sections 'A', 'B', and 'C'.

Figure 9A:
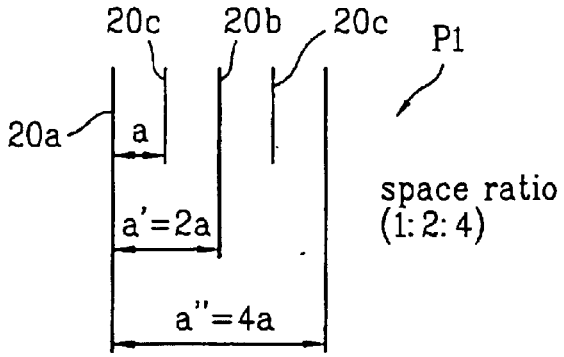

In the meantime, the arrangement pattern 'P' can be defined by the lengths of the fins 20, the sequence of arrangement of the fins 20, and the spaces between fins 20. In the arrangement pattern 'P' as shown in FIG. 7, basically fins with at least more than 3 different lengths are arranged, adjacently. In more detail as shown in FIG. 9A, a fin 20*b* with a middle length is arranged between one pair of the most longest fins 20*a*, and a fin 20*c* with the shortest length is arranged every space between the most longest fin 20*a* and the fin 20*b* with the middle length. If the fins 20 are arranged at equal spaces, the spaces 'a', 'a'', and 'a"' between adjacent fins 20 which form independent flow spaces have a ratio of 1:2:4. Moreover, the basic arrangement pattern P1 in FIG. 9A can be expanded to an arrangement pattern P1' in FIG. 9B, by adding a fin 20*b*' with another middle length longer than the fin 20*b* with the middle length between the longest fin 20*a* and the shortest fin 20*c* adjacent to the longest fin 20*a*, and by adding fins between the another longest fin 20*b* and the fin 20*b*' with another middle length between the fin 20*b*' with the another middle length and the longest fin 20*a*. Under the same fashion as explained before, the basic arrangement pattern P1 is expanded from the arrangement pattern P1' to an arrangement pattern P1" in FIG. 9C that further includes a fin 20*b*" with another middle length longer than the fin 20*b*' with the another middle length 20*b*', and, alikely, arrangement patterns expanded more than this can be formed. Moreover, as shown in FIGS. 9A–9C, a number of sections with different fin spaces in the heat exchanger is increased as the arrangement pattern P1 is expanded.

Figure 9B:
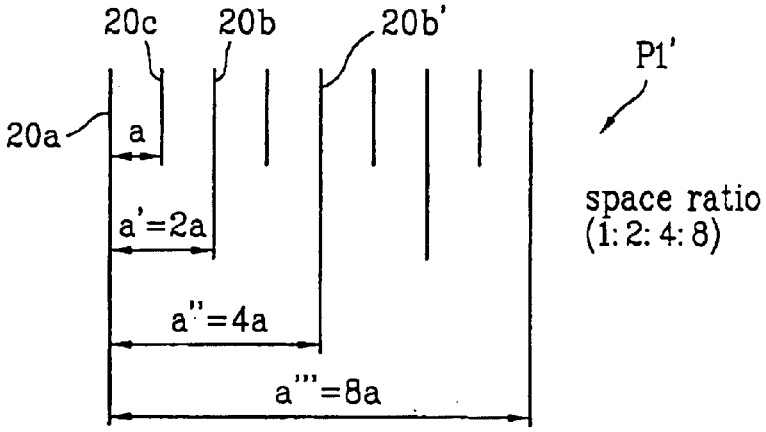
Figure 9C:
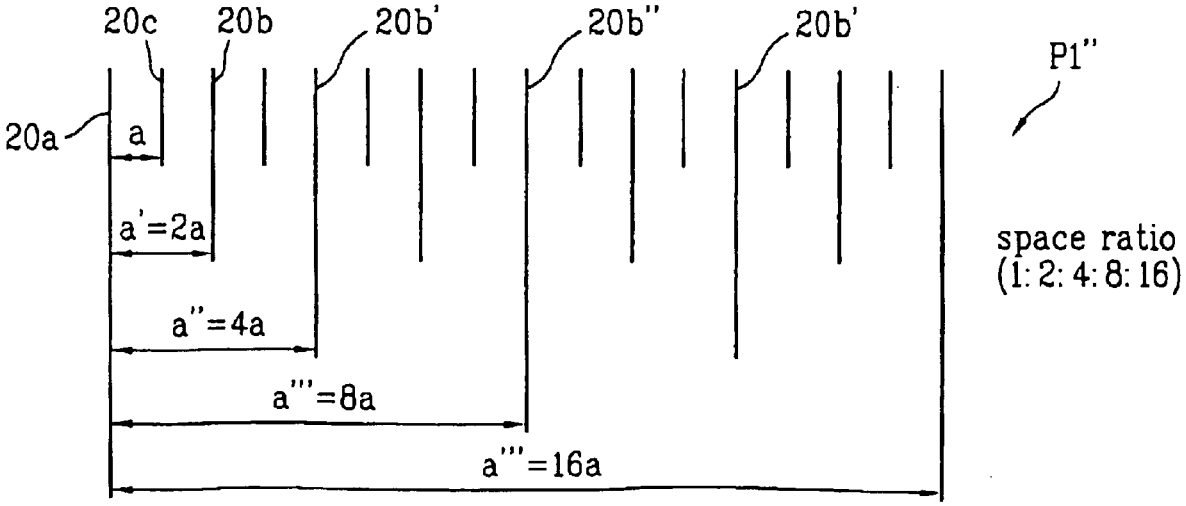

In more detail, the spaces 'a', 'a'', 'a"', and 'a"'' between adjacent fins has a ratio of 1:2:2*2(4):2*4(8) in the arrangement pattern P1' in FIG. 9B, and the spaces 'a', 'a'', 'a"', 'a"'' and 'a"'' between adjacent fins has a ratio of 1:2:2*2(4):2*4(8):2*8(16) in the arrangement pattern P1" in FIG. 9C. Eventually, the fin space ratio can be generalized to $2\cdot2^{(n-1)}$ ($n\geqq1$) times of the smallest fin space 'a'.

Also, by adding one or two of the shortest fin 20*c* to every space between the fin 20*b* with a middle length and the longest fin 20*a* in the basic pattern P1 in FIG. 9A, other arrangement patterns P2 and P3 respectively shown in FIGS. 10 and 11 can be obtained, wherein the ratios of adjacent fin spaces 'a', 'a'', and 'a"' are 1:3:6, and 1:4:8 respectively, and may be expanded in the same fashion as the FIGS. 9B and 9C. Accordingly, the fin space ratios of the arrangement patterns P2 and p3 can be increased to $3\cdot2^{(n-1)}$($n\geqq1$) times and $4\cdot2^{(n-1)}$ ($n\geqq1$) times of the smallest fin space respectively, and, alikely, the foregoing expansion of the fin arrangement pattern brings about an increase of a number of sections with spaces different from one another.

In general, the arrangement patterns P1, P2, and P3 are characterized by the generalized fin space ratios $2\cdot2^{(n-1)}$, $3\cdot2^{(n-1)}$, and $4\cdot2^{(n-1)}$ ($n\geqq1$), together with the expanded patterns. The arrangement patterns P1, P2, and P3 are exemplary, and variations of other arrangement patterns P other than these can be applied as required.

At the end, the application of different lengths and the variations of the geometrical form according to the application thereof suppress clogging of the fin 20 space by frost in a straight fin type heat exchanger of the present invention, that in turn drops the pressure loss caused by an increased flow resistance. On the other hand, there are certain spaces formed in a lower part of the heat exchanger, that drops an initial flow resistance and the pressure loss caused by the flow resistance at initial air introduction into the heat exchanger.

As explained, even if the heat exchanger of the present invention has in general a smaller size, simple, and improved performance compared to the discrete type fin heat exchanger, a better performance is obtainable by optimization of design. Particularly, when the variation of the heat exchanger performance expected from the application of fins of different lengths is taken into account, the design optimization is further required. To do this, the present invention fixes an optimal design scope through the following tests and simulations.

Factors that influence to the heat exchanger performance are in general design and fabrication methods, and materials. Particularly, of the design factors, it is known that the fin space 'a', the fin arrangement pattern P, and the section with the smallest fin space (the section 'A') give the greatest influences to the performance through preliminary tests. (See FIGS. 7 and 8). Accordingly, the design factors 'a', 'P', and section 'A' are taken as objects of measurements for the optimization in the tests and simulations, while other design factors, such as a width 'W', a length 'L', and a thickness 't' of the heat exchanger, fabricating method/material factors, and operation conditions are fixed constant.

Also, as a reference for evaluation of the heat exchanger performance, the following most general coefficient is taken into consideration at first.

$$\frac{Q}{\Delta P}$$

(Where Q: heat exchange rate W, and ΔP: pressure drop Pa)

As known, the heat exchange rate, and the pressure drop are the most important characteristics in view of a heat exchanger operation. The heat exchange rate is directly connected to a performance variation for itself, and the pressure drop causes performance deterioration when the pressure drop is increased due to decreased flow rate. That is, when the pressure drop is high during operation, a fan with a higher power is required for maintaining a minimum cooling capability required for the refrigerator.

However, the coefficient applied actually show a low correlation, with a wide distribution depending on test conditions. Therefore, the following new performance evaluation coefficient is suggested for determining a performance level, even if a geometric form of the heat exchanger (particularly the fin) is varied without influenced from the test conditions.

$$F = \frac{Q/\Delta T^{0.5}}{\Delta P^{0.34}} \ (\mathrm{m^3/s \cdot C.})$$

Where,

Q: heat exchange rate W.

ΔP: pressure drop Pa, and

ΔT: log mean temperature difference between air and refrigerant ° C.

In order to obtain the performance evaluation coefficient 'F', influence analyses and regression analyses are conducted for various factors, to find that an air temperature, a refrigerant temperature, and air mass flow rate are the most significant factors. Of the significant factors, the log mean temperature difference between air and refrigerant (LMTD, ΔT is inserted to the performance evaluation coefficient. It is known that the greater the LMTD, the poorer the performance, and the smaller the LMTD, the better the performance. For taking interaction between the pressure drop and the LMTD into account, respective exponents are fixed through responsive surface test. Thus, the performance evaluation coefficient 'F' facilitates a more accurate, and statically significant performance evaluation by taking the temperatures of the air and the refrigerant, the significant factors, into account on the same time. Also, as can be noted from the equation, the greater the performance evaluation coefficient 'F', the higher the performance of the heat exchanger, and it is verified that when the coefficient 'F' is greater than 20 $m^3/s\cdot°$ C., the heat exchanger has a performance higher than a general level.

Test results based on the foregoing factors and performance evaluation reference selected thus are shown in FIGS. 12A and 12C. That is, variations of the performance evaluation coefficient 'F' caused by the smallest fin space 'a' (hereafter, "space a") and the section with the smallest fin spaces (section A) (hereafter, "section A") are shown in FIGS. 12A and 12C. Separate tests are conducted for the foregoing arrangement patterns P1, P2, and P3 (See FIGS. 9–11), wherein FIG. 12A is for the arrangement pattern P1, FIG. 12B is for the arrangement pattern P2, and FIG. 12C is for the arrangement pattern P3.

In each test, a ratio of the section A is represented with percentage % of an entire heat exchanger size, which is a part an actual heat exchange is made as shown in FIGS. 7 and 8, i.e., a length L*a width W*a thickness T. Ratios of the other sections may be adjusted according to the ratio of the selected section A. The space a is a space between adjacent fins. The variables Q. ΔP, and ΔT in the performance evaluation coefficient F are averages for 50 to 60 minutes.

It can be noted from contours in FIGS. 12A–12C that the ratio of the section A is in general more sensitive to in the performance evaluation coefficient F than the space a. That is, in a fixed pattern P, the section A ratio is a governing design factor over the performance evaluation coefficient F compared to the space a. Also, it can be noted that the arrangement pattern P1 is the most favorable for the performance improvement since there is a region having the greatest performance evaluation coefficient (F=40 $m^3/s\cdot°$ C.) in FIG. 12A. Therefore, the most effective design range can be obtained with reference to the section A ratio in FIG. 12A (the arrangement pattern P1).

In FIG. 12A, a lower limit of the design range for performance improvement is a region the coefficient F is greater than 20 $m^3/s\cdot°$ C., in which the section A ratio is below 75% of the entire heat exchanger size. Though a minimum of the section A ratio approaches to zero in a region F≧20 $m^3/s\cdot°$ C. on the drawing, it is required that the section A ratio is greater than 5% actually. The space a in the region F≧20 $m^3/s\cdot°$ C. is approx. 1 mm–13 mm.

A more preferable design range is a region F≧30 $m^3/s\cdot°$ C., with the section A ratio 5%–65% and the space a 2 mm–12 mm, approximately. It can be determined that a region with F≧40 $m^3/s\cdot°$ C. in the central part of the drawing is the most optimal design range. Thus, the most optimal range in the present invention falls on the section A ratio of approx. 15%–55%, and the space a of 4 mm–10 mm.

On the other hand, though the most effective design ranges of test results of other arrangement patterns P2 and P3 are not shown in FIGS. 12B and 12C respectively, regions the performance evaluation coefficient F is greater than 20 are also effective design ranges for the improvement of the performance.

In a case of the arrangement pattern P2 as shown in FIG. 12B, the section A ratio and the space a falling on a region F≧20 $m^3/s\cdot°$ C. are 15%–75%, and 3 mm–13 mm, respectively. Preferably, the section A ratio and the space a falling on a region F≧30 $m^3/s\cdot°$ C. are 25%–65%, and 5 mm–12 mm, respectively.

In a case of the arrangement pattern P3 as shown in FIG. 12C, the effective design range for performance improvement (F≧20 $m^3/s\cdot°$ C.) falls on a section A ratio greater than 25%, and the space a 5 mm–15 mm, respectively. Preferable design range (F≧30 $m^3/s\cdot°$ C.) falls on the section A ratio greater than 35% and the space a 6 mm–13 mm, respectively. As shown, though a maximum section A ratio in regions F≧30 $m^3/s\cdot°$ C. and F≧20 $m^3/s\cdot°$ C. are 80% or over, if the section A ratio exceeds 75%, there is a possibility that the fin space clogging by frost is occurred earlier due to excessive increase of the section A ratio. Therefore, it is required that the section A ratio in the arrangement pattern P3 is below 75%.

In the foregoing design ranges, all section A ratios in the arrangement patterns P2 and P3 ale contained in the upper limit of the section A ratio of below 75% in the arrangement pattern P1. Thus, the section A ratio 75% is applicable to a heat exchanger design regardless of the arrangement pattern.

Besides, tests and simulations are selectively conducted for the expanded arrangement patterns, i.e., heat exchangers (see FIGS. 9–12) in each of which the number of sections halving different fin spaces are increased, to find all the design ranges selected before are verified in the same fashion, again.

Though the heat exchanger performance is maximized by the optimal design range obtained thus, it is important that the maximized performance is maintained, constantly. In the heat exchanger, a major problem is the continuous growth of frost during actual use no matter how hard the growth of the frost is suppressed, and the consequential gradual deterioration of the performance. Therefore, the present invention suggests setting up a design range additionally through tests and simulations for securing operation reliability even under a severe working condition, i.e., with much frost.

At first, the smallest fin space 'a' and the section with the largest fin space (section 'C') are selected as design factors that influence the reliability. Alike the foregoing tests for performance improvement, the space 'a' is identified as an important factor from a preliminary test, and the section 'C' is an important factor because the section 'C' is a part the frost is the most severe.

Also, as references for evaluation of a reliability of the heat exchanger, the heat exchange rate, a time period taken for a 55 Pa pressure drop, and a performance evaluation coefficient F' 8 minutes after starting are selected, which will be explained.

1. Heat Exchange Rate

Referring to FIG. 13, in general, a minimum cooling capacity required for a refrigerator in an actual operation is 325W, with an air volumetric flow rate of 0.3 $m^3/m$. However, it is required that the heat exchange rate is 2 or 2.5 times of the minimum cooling capacity for securing a stable operation state under a severe ambient of heavy frosting. Therefore, the heat exchange rate required for securing the reliability of the heat exchanger is greater than 800W.

2. Time Period Taken for a 55 Pa Pressure Drop

Referring, to FIG. 13, for securing a minimum cooling capacity of a refrigerator, the air volumetric flow rate of 0.3 $m^3/m$ is required. The pressure drop for the 0.3 $m^3/m$ air volumetric flow rate is 47 Pa in FIG. 14 illustrating a graph showing a pressure loss vs. a volumetric flow rate of air during regular operation of the refrigerator. As shown in FIG. 14, since the pressure drop is inversely proportional to the air volumetric flow rate, it is required that the pressure drop is managed to be blow 47 Pa for obtaining an air volumetric flow rate greater than the minimum air volumetric flow rate. However, in a case the refrigerator is operative under a severe working condition, an upper limit of the pressure drop can be increased up to 55 Pa because, in general, a blow rate is forcibly increased. In the meantime, it is verified that the upper limit value is reached within 45±3.6 min. when the refrigerator is tested under the severe condition, and 41 min., the lowest value, is set up as a lower limit. Accordingly, for smooth operation of the refrigerator under the severe condition, it is necessary that the time period taken for a 55 Pa pressure drop is not less than 41 min.

3. Performance Evaluation Coefficient F' 8 Minutes After Starting

As explained, the accumulation of the frost affects the operation reliability significantly, and, of the factors having significance to the performance, is directly related to a air mass flow rate that passes through the heat exchanger. Also, even from the influence analyses and the regression analyses, it is verified that the air mass flow rate is significant to the performance under a severe working condition (heavy frost) more than the air/refrigerant temperatures that are identical significant performance factors. Therefore, for application of the performance evaluation coefficient in view of an operation reliability, a new performance evaluation coefficient F' is suggested as follows taking the air mass flow rate into account.

$$F' = \frac{Q}{\Delta P \cdot \dot{m}_{air}}$$

Where.

Q: heat exchange rate W.

ΔP: pressure drop Pa, and $\dot{m}_{air}$: air mass flow rate g/s.

The greater the air mass flow rate, the greater the air flow speed in the heat exchanger, and the poorer the heat exchange rate due to reduction of a heat exchange time period with the fins. That is, the greater the air mass flow rate, the poorer the performance, and the smaller the air mass flow rate, the better the performance. Therefore, the air mass flow rate and the performance evaluation coefficient F' are made to have an inversely proportional relation. Eventually, the performance evaluation coefficient F' is represented with a ratio of an input energy to an output energy, and dimensionless.

In the meantime, an actual pressure drop in the heat exchanger of the refrigerator does not exceed 11 Pa–14 Pa under a regular operation condition. Such a pressure drop is reached within 8 minutes after starting in the severe condition test, when the performance evaluation coefficient F' is 0.76±0.055. It is important in view of the operation reliability that a general (regular) pressure drop (11 Pa–14 Pa) is maintained even under the severe condition, which can be evaluated quantitatively by the performance evaluation coefficient F' 8 minutes after starting. It may be assumed that the operation (of the heat exchanger) is reliable when the performance evaluation coefficient F' 8 minutes after starting is 0.705, which is a lower limit under the severe condition. Results of basic tests on the selected factors and reliability evaluation references are illustrated in FIGS. 15A–16. FIGS. 15A–15C illustrate graphs showing respective reliability evaluation references vs. space 'a', and a ratio of the section with the largest fin spaces (section 'C') (here after call as, "section C"). In more detail. FIG. 15A illustrates a graph for the heat exchange rate. FIG. 15B illustrates a graph for a time period for a 55 Pa pressure drop, and FIG. 15C illustrates a graph for the performance evaluation coefficient 8 min. after starting F'. In all the tests, the arrangement pattern P is fixed at P1 that is the most favorable for performance improvement.

A size of the section 'C' is represented with percentage of a size of whole heat exchanger, and the space 'a' is an actual space between adjacent fins in the section A alike all the foregoing tests for performance improvement.

It is noted from the test results that, in FIG. 15A, reductions of the space 'a' and the section 'C' are favorable for an increased heat exchange rate, and a region with the heat exchange rate greater than 800W has an operation reliability. It is noted in FIG. 15B that the smaller the space 'a', the shorter the time period taken for a 55 Pa pressure drop. That is, an increase rate of the pressure drop becomes the greater, which implies that the clogging by the frost growth develops the faster, indicating that an excessive reduction of the space 'a' affect the reliability directly. And, a region with operation reliability exists in over 41 min. time period taken for 55 Pa pressure drop. In FIG. 15C, the performance evaluation coefficient F' 8 minutes after starting increases as the section 'C' ratio and the space 'a' decrease. This is because the pressure drop is small due to small initial frost formation even if the space 'a' is reduced. The section 'C' ratio and the space 'a' within the region the performance evaluation coefficient F' is greater than 0.705 are reliable design values.

For finding a design range having all the reliability evaluation references taken into account, all the test results are put together in FIG. 16.

In more detail, reliability regions of the heat exchange rate vs. the space 'a' and the section 'C' ratio in FIG. 15A, the time period taken for a 55 Pa pressure drop in FIG. 15B, and the performance evaluation coefficient F' 8 min. after starting, in FIG. 15C are overlapped in FIG. 16. In general, the space 'a' is sensitive to the reliability evaluation references more than the section 'C' ratio. However, since the design range is set up with reference to the section 'A' ratio for performance improvement, the section 'C' ratio, which is relative to the section 'A' ratio is taken into consideration with a first priority in determination of a reliable design range in view of design.

Referring to FIG. 16, a white region represents a design range that meets all the reliability determination references. Though a minimum value of the section 'C' ratio is 0% in the white region, the section 'C' will be at a certain ratio inevitably as far as fins having different fin lengths are applied. Though a maximum of the section 'C' ratio is not specified, if the section 'C' ratio exceeds 35%, the capability is dropped due to an excessive reduction of an actual heat exchange area. The white area size changes sharply at approx. 18% of the section 'C' ratio (up and down directions in the drawing). Therefore, an available section 'C' ratio can be divided into two regions with reference to 18%, a first region 1%–18% and a second region 18%–35%, which are compared to a preset section 'A' ratio on the following table for fixing a final design range. In the following tables, a maximum value of the section 'C' ratio is fixed relative to a maximum of the section 'A' ratio, and ratios of the section 'A' and section 'C' can be adjusted as required within maximum ranges fixed thus.

| 1. First Region (section 'C' ratio 1%–18%) | | | |
|---|---|---|---|
| Section 'A' ratio (%), max | 75% (F > 20) | 65% (F > 30) | 55% (F > 40) |

-continued

| 1. First Region (section 'C' ratio 1%–18%) | | | |
|---|---|---|---|
| Section 'C' ratio (%), max | 18% | 18% | 18% |
| Rest of the section ratio (%) | 7% | 17% | 27% |

*Arrangement pattern P1

Since all available maximum section 'C' ratios are 18%, the entire first region can be used for all the preset section 'A' ratio. That is, of the design range for securing the reliability, the section 'C' is below 18% of the entire heat exchanger size. According to the section 'C' ratio set up thus, the section 'a' can be obtained from a region represented with solid lines and dashed lines in a lower part of FIG. 16. In more details, the region with dashed lines is a design region available without any particular problem, though the area is larger than the white area, in which the space 'a' ranges 5.5 mm–10 mm. The region with the solid lines is an optimal design range in the white region, with the space 'a' being 8.1 mm–9.1 mm (7.6±1.5 mm).

| 2. Second Region (section 'C' ratio 18%–35%) | | | |
|---|---|---|---|
| Section 'A' ratio (%), max | 75% (F > 20) | 65% (F > 30) | 55% (F > 40) |
| Section 'C' ratio (%), max | 25% | 35% | 35% |
| Rest of the section ratio (%) | 0% | 0% | 10% |

*Arrangement pattern P1

When the section 'A' ratio has a maximum value of 75% in above table, a maximum available section 'C' ratio is 25%, and when the section 'A' ratio has a maximum value of 65%, and 55% in above table, a maximum available section 'C' ratio is 35%. Therefore, the section 'C' ratio in the second region has two independent reliability ranges, i.e., 18%–25% for the section 'A' design range, and 18%–35% for section 'A' design range 5%–65%, and 15%–35%.

At first, with regard to the section 'C' ratio of 18%–35%, available section 'a' is 6 mm–8.5 mm, falling on the dashed lines the same as the first region. An optimal space 'a' in the solid lines is 6.2–8.0 mm.

And, with regard to the section 'C' ratio of 18%–35%, available section 'a' is 6.1 mm–8.2 mm (dashed lines), and the optimal space 'a' is 6.5–7.7 mm (the solid lined region).

In the meantime, as shown in FIG. 17, the fin 20 may have a sloped top edge 22 and a sloped bottom edge 23. The sloped bottom edge 22 facilitates a smooth discharge of the defrosted water. That is, the defrosted water does not stay at the bottom edge 22 by a surface tension, but flows down along the bottom edge 22, is collected at a tip 22*a* where the slope of the edge 22 ends, and is dropped by gravity. In actual formation of the fins 20, a cutter cuts sheets of thin plate in succession by using one pair of blades. Therefore, once the one pair of the blades are set to be sloped in the formation for obtaining the sloped bottom edge 22, not only the bottom edge 22, but also the top edge 23, are sloped. As additional formation of the top edge 93 requires additional cost, it is preferable the top edge 23 is maintained as sloped in an initial formation as it is. Along with this, a slope direction of the top edge 23 is made to be the same with the bottom edge 22.

Referring to FIGS. 18A–18B, the bottom edge 22 will be explained in detail.

Basically, the bottom edge 22 may have only one slope. Or, as shown in FIGS. 19A–19C, the bottom edge 22 may have multiple slopes, which can accelerate discharge of the defrosted water. In more detail, the multiple slopes may have one bottom (FIG. 9A) and one peak (FIG. 9B), or a plurality of peaks and bottoms (FIG. 9C). Along with these, as shown in FIGS. 20*a*–20*e*, the foregoing different slopes may have curvatures, and the variations carry out a function identical to the slopes in FIGS. 18A–19C, actually.

Even when bottom edge 22 is sloped, complete discharge of the defrosted water is difficult. The defrosted water is left at the tip 22*a* of the bottom edge 22, from which frost grows, intensively. Therefore, it is preferable that bottom edges 22 are arranged such that the tips 22*a* of the bottom edges 22 do not face each other. That is, in a case of one slope as shown in FIG. 21A, bottom edges 22 having inverse slope directions are arranged, repeatedly. In a case of multiple slopes as shown in FIG. 21B, the one peaked bottom edge 29 (FIG. 9B) and the one bottomed bottom edge 22 (FIG. 9A) are arranged, alternately.

Meanwhile, the defrosted water discharge capability may vary with an angle of the slope, and FIG. 22 illustrates the variation of discharge capability with reference to variation of amount of the defrosted water, experimentally. As shown, it can be noted that the remained defrosted water is the smallest when the slope angle θ is 20°–30°. Considering other design conditions, it is proved that it is the most preferable when the slope angle of the bottom edge is 23°.

Along with this sloped bottom edge 22, as shown in FIG. 23, the heat exchanger of the present invention may further includes a sloped member 40 in contact or adjacent to the peak 22*a* of the lower edge 22. The sloped member 40 is fitted to an air flow passage in the refrigerator, together with the heat exchanger, for inducing more effective discharge of the defrosted water collected at the peak 22*a*.

In addition to this, as shown in FIG. 24, it is preferable that the fin 20 has a plurality of louvers 24 and slits 25 formed along a length direction thereof. The louver 24 primarily increases a heat exchange area, and forms turbulence between the fins 20 to make heat exchange during air flow. The slit 25 forms an air flow passage crossing the fins 20, for facilitating a smooth air flow even if adjacent fin 20 space is blocked by the grown frost, locally. Actually, the louvers 24*a*, and 24*b* and the slits 25*a* and 25*b* may be formed only on one face of the fin 20 as shown in FIG. 25A, or alternately on both faces with reference to a certain fin as shown in FIG. 25B. In FIG. 25B, it is preferable that the louvers 24*a*, and 24*b* and the slits 25*a* and 25*b* are arranged alternately so that the louvers 24*a*, and 24*b* and the slits 25*a* and 25*b* are not opposite. This is because, if the louvers 23 are opposite, the fin 20 space is liable to be blocked by the frost.

In the heat exchanger of the present invention, the reinforcing plate 30 has a relatively thick thickness for protecting the fins 20, and a length longer than the fin 20 for inducing air flow into the heat exchanger. In detail, as shown in FIG. 26, since the reinforcing plate 30 is coupled with the refrigerant tube 10, the reinforcing plate 30 has a plurality of through holes 31 similar to the fins 20. It is preferable that the reinforcing plate 30 further includes at least more than one slit 32 in communication with the slits 24 in the fill 20, for securing additional flow passage. Because the reinforcing, plate 30 also heat exchanges with the air introduced during cooling, there is frost and defrosted water formed on a surface of the reinforcing plate 30. Therefore, for easy discharge of the defrosted water, a slope may be formed at a bottom edge 33 of the reinforcing plate 40 similar to the bottom edge 22 of the fin 20 explained before.

In the meantime, the heat exchanger of the present invention has a defroster 50 of a resistance wire for removing the frost. As shown in FIG. 27A, even if the defroster 50 is fitted only to a bottom part of the heat exchanger of the present invention at a fixed distance, the defrosting can be made effectively only by thermal radiation and convection. This is because the heat exchanger of the present invention has formation of frost reduced significantly owing to the foregoing various structural features. Moreover, as shown in FIG. 27B, only arrangement of the defroster 50 to pass a neighborhood of the fins 20 only once facilitate to obtain a further enhanced defrosting effect. For uniform thermal radiation, it is preferable that the defroster 50 is arranged in the vicinity of middle of the fins 20. Accordingly, the fin 20 further includes a notch 26 in the middle thereof for receiving the defroster 50, and the reinforcing plate 30 also hat the same notch 34.

As explained, the simple defroster 50 is made available from the continuous straight fin 20 and the various structural features, and, accordingly, an overall assembly of the heat exchanger becomes easy and has a reduced air flow resistance. Even though a defroster 50 applied to a heat exchanger having the same fin lengths is explained in FIGS. 27A and 27B, the defroster 50 may be applied to a heat exchanger having fin lengths different from one another in the same fashion has the same effect.

It will be apparent to those skilled in the art that various modifications and variations can be made in the heat exchanger for a refrigerator of the present invention without departing from the spirit or scope of the invention. Thus, it is intended that the present invention cover the modifications and variations of this invention provided they come within the scope of the appended claims and their equivalents.

INDUSTRIAL APPLICABILITY

In the present invention, basically the application of the continuous straight fin improves a defrosted water discharge capability, and suppresses formation of frost from the root. The difference of fin lengths and sloped bottom prevent the air flow passage from being blocked by the frost, and improves drainage. Moreover, the slits and louvers on the fin carry out supplementary functions for operation of the heat exchanger. Eventually, in the present invention, a pressure loss caused by a flow resistance and a reduction of a heat exchange area are prevented, and, consequently, a heat exchange performance is improved. Particularly, by setting up an optimal design range for improvement of performance and securing reliability of the heat exchanger, taking great shape characteristic variation and performance variation into account, a more improved heat exchange performance is expected.

The simple structure of the fin of the present invention permits an easy assembly of the heat exchanger compared to the discrete discontinues fin in the related art. Together with this, the application of a straight fin simplifies a defroster structure. That is, the heat exchanger of the present invention has reduced number of components compared to the related art, has a reduced production cost and improved productivity since no separate forming, and assembly process are not required. Moreover, by applying the straight fin, the present invention can implement the same heat exchange performance even with a smaller sized heat exchanger.

At the end, the foregoing improved heat exchange performance and the simple structure of the heat exchanger of the present invention is optimized to suit to a refrigerator.

What is claimed is:

1. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another, wherein a section having the smallest fin spaces is below 75% of an entire size of the heat exchanger and wherein the fin spaces increase by $2\cdot2^{(n-1)}$ times the smallest space, where $n\geqq1$.

2. The heat exchanger as claimed in claim 1, wherein the section with the smallest fin spaces is greater than 5% of the entire size of the heat exchanger.

3. The heat exchanger as claimed in claim 1, wherein the section with the smallest fin spaces is 5%–65% of the entire size of the heat exchanger.

4. The heat exchanger as claimed in claim 3, wherein the smallest fin space is 2 mm–12 mm.

5. The heat exchanger as claimed in claim 3, wherein the section with the largest fin spaces is 18%–35% of the entire size of the heat exchanger.

6. The heat exchanger as claimed in claim 5, wherein the smallest fin space is 6.1 mm–8.2 mm.

7. The heat exchanger as claimed in claim 6, wherein the smallest fin space is 6.5 mm–7.7 mm.

8. The heat exchanger as claimed in claim 1, wherein the section with the smallest fin spaces is 15%–55% of the entire size of the heat exchanger.

9. The heat exchanger as claimed in claim 8, wherein the smallest fin space is 4 mm–10 mm.

10. The heat exchanger as claimed in claim 1, wherein the section with the largest fin spaces is below 18% of the entire size of the heat exchanger.

11. The heat exchanger as claimed in claim 10, wherein the smallest fin space is 5.5 mm–10 mm.

12. The heat exchanger as claimed in claim 11, wherein the smallest fin space is 6.1 mm–9.1 mm.

13. The heat exchanger as claimed in claim 1, wherein the section with the largest fin spaces is 18%–25% of the entire size of the heat exchanger.

14. The heat exchanger as claimed in claim 13, wherein the smallest fin space is 6.0 mm–8.5 mm.

15. The heat exchanger as claimed in claim 14, wherein the smallest fin space is 6.2 mm–8.0 mm.

16. A heat exchanger for a refrigerator, comprising:

one or more refrigerating tubes for flow of refrigerant; and a plurality of fins having lengths different from one another for coupling with the one or more refrigerating tubes having portions positioned substantially in parallel to one another at fixed intervals, the one or more refrigerating tubes passing through pass through holes formed in the plurality of fins, to form sections having fin spaces formed between the fins different in size from one another, wherein the fin spaces increase by $2\cdot2^{(n-1)}$ times of the smallest fin space, where $n\geqq1$.

17. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different from one another, wherein the fin spaces are formed by an arrangement pattern having a longest one pair of fins, fins with intermediate lengths arranged between the one pair of the longest fins, and the shortest fins arranged in every space between the one pair of the longest fins and the fins with intermediate lengths and wherein the fin spaces increase by $2\cdot2^{(n-1)}$ times of the smallest fin space, where $n\geqq1$.

18. The heat exchanger as claimed in claim 17, wherein the fin spaces formed between adjacent fins in sections have a ratio of 1:2:4.

19. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different from one another, wherein a section with the smallest fin spaces is below 75% of an entire size of the heat exchange, wherein the smallest fin space is 1 mm–13 mm, and wherein the fin spaces increase by $2\cdot2^{(n-1)}$ times of the smallest fin space, where $n\geqq1$.

20. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different from one another, wherein the fin spaces increase in sections by $3\cdot2^{(n-1)}$ times of the fin space of the section with the smallest fin spaces, and the section with the smallest fin spaces is 15%–75% of the entire size of the heat exchanger, where $n\geqq1$.

21. The heat exchanger as claimed in claim 20, wherein the fin spaces increase in sections by $3\cdot2^{(n-1)}$ times of the fin space of the section with the smallest fin spaces, and the section with the smallest fin spaces is 25%–65% of the entire size, where $n\geqq1$.

22. The heat exchanger as claimed in claim 21, wherein the smallest fin space is 5 mm–12 mm.

23. The heat exchanger as claimed in claim 20, wherein the fin spaces are formed by an arrangement pattern having a longest one pair of fins, fins with intermediate lengths arranged between the one pair of the longest fins, and two shortest fins arranged in every space between the one pair of the longest fins and the fins with intermediate lengths.

24. The heat exchanger as claimed in claim 23, wherein the fin spaces formed between adjacent fins in sections have a ratio of 1:3:6.

25. The heat exchanger as claimed in claim 20, wherein the smallest fin space is 3 mm–13 mm.

26. A heat exchanger for a refrigerator, comprising:

one or more refrigerating tubes for flow of refrigerant; and a plurality of fins having lengths different from one another for coupling with the one or more refrigerating tubes having positions arranged substantially in parallel to one another at fixed intervals, the one or more refrigerating tubes passing through pass through holes formed in the plurality of fins, to form sections having fin spaces formed between the fins different from one another, wherein the fin spaces increase in sections by $4 \cdot 2^{(n-1)}$ times the fin space of the section with the smallest fin spaces, and the section with the smallest fin spaces is 25%–75% of the entire size of the heat exchanger, where $n \geqq 1$.

27. The heat exchanger as claimed in claim 26, wherein the fin spaces increase in sections by $4 \cdot 2^{(n-1)}$ times the fin space of the section with the smallest fin spaces, and the section with the smallest fin spaces is 35%–75% of the entire size of the heat exchanger, where $n \geqq 1$.

28. The heat exchanger as claimed in claim 27, wherein the smallest fin space is 6 mm–13mm.

29. The heat exchanger as claimed in claim 26, wherein the fin spaces are formed by an arrangement pattern having a longest one pair of fins, fins with intermediate lengths arranged between the one pair of the longest fins, and three shortest fins arranged in every space between the one pair of the longest fins and the fins with intermediate lengths.

30. The heat exchanger as claimed in claim 29, wherein the fin spaces formed between adjacent fins in sections have a ratio of 1:4:8.

31. The heat exchanger as claimed in claim 26, wherein the smallest fin space is 5 mm–15 mm.

32. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another, wherein each fin includes a top edge and a bottom edge, both of which are sloped at an angle.

33. The heat exchanger as claimed in claim 32, wherein the top edge and the bottom edge of each fin have the same slope directions.

34. The heat exchanger as claimed in claim 32, wherein the bottom edge of each fin has a single slope.

35. The heat exchanger as claimed in claim 34, wherein the lower edges of the respective fins are arranged such that no tips of the lower edges face each other.

36. The heat exchanger as claimed in claim 35, wherein the fins having single sloped bottom edges are arranged in opposite slope directions, alternately.

37. The heat exchanger as claimed in claim 35, wherein the multiple slopes of each fin form either a single peak or a single bottom, and wherein the bottom edge of each fin with a single peak and the bottom edge of each fin with a single bottom are arranged, alternately.

38. The heat exchanger as claimed in claim 34, wherein the slope of each fin has a curvature.

39. The heat exchanger as claimed in claim 32, wherein the bottom edge of each fin has multiple slopes.

40. The heat exchanger as claimed in claim 39, wherein the multiple slopes form only a bottom.

41. The heat exchanger as claimed in claim 39, wherein the multiple slopes form only a peak.

42. The heat exchanger as claimed in claim 39, wherein the multiple slopes form one or more peaks and bottoms.

43. The heat exchanger as claimed in claim 32, wherein the angle of slope of the bottom edge of each fin is within a range of 20°–30°.

44. The heat exchanger as claimed in claim 43, wherein the angle of slope of the bottom edge of each fin is 23°.

45. The heat exchanger as claimed in claim 32, further comprising a sloped member in contact with, or adjacent to, the tips of the bottom edges.

46. A heat exchanger for a refrigerator, comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another, wherein each fin includes a plurality of slits and louvers formed along a length direction thereof.

47. The heat exchanger as claimed in claim 46, wherein the slits and louvers are formed on either face of each fin.

48. The heat exchanger as claimed in claim 46, wherein the slits and louvers are on both faces of each fin, alternately.

49. The heat exchanger as claimed in claim 47, wherein the slits and louvers on adjacent fins are arranged, alternately.

50. A heat exchanger for a refrigerator, comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another; and a pair of reinforcing plates coupled to opposite ends of straight parts of the one or more refrigerating tubes and arranged in parallel to the plurality of fins, wherein the plates each include at least one slit for communication with slits provided in the plurality of fins.

51. A heat exchanger for a refrigerator, comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another; and a pair of reinforcing plates coupled to opposite ends of straight parts of the one or more refrigerating tubes and arranged in parallel to the plurality of fins, wherein the reinforcing plates each include a bottom edge sloped at an angle.

52. A heat exchanger for a refrigerator, comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections with fin spaces different from one another; and a defroster fitted to the heat exchanger spaced a fixed distance from bottom edges of the plurality of fins for removal of frost on the one or more refrigerating tubes and the plurality of fins, wherein the fin spaces increase by $2 \cdot 2^{(n-1)}$ times of the smallest fin space, where $n \geqq 1$.

53. The heat exchanger as claimed in claim 52, further comprising a pair of reinforcing plates coupled to opposite ends of straight parts of the one or more refrigerating tubes and arranged substantially in parallel to the plurality of fins.

54. The heat exchanger as claimed in claim 53, wherein the defroster is arranged to pass through a middle part of the plurality of fins and the reinforcing plates.

55. A heat exchanger for a refrigerator, comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections with fin spaces different from one another;

a defroster fitted to the heat exchanger spaced a fixed distance from bottom edges of the plurality of fins for removal of frost on the one or more refrigerating tubes and the plurality of fins; and a pair of reinforcing plates coupled to opposite ends of straight parts of the one or more refrigerating tubes and arranged substantially in parallel to the plurality of fins, wherein the plurality of fins and the reinforcing plates each include notches for receiving the defroster.

56. A heat exchanger for a refrigerator, comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another to form an arrangement pattern having three fin types of different arranged adjacently, wherein the arrangement pattern includes:

one pair of longest fins, fins with intermediate lengths arranged between the one pair of longest fins, and shortest fins arranged in every space between the one pair of longest fins and the fins with intermediate lengths, wherein the fin spaces formed between adjacent fins in sections have a ratio of 1:2:4.

57. A heat exchanger for a refrigerator comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another to form an arrangement pattern having three fin types of different length arranged adjacently, wherein the arrangement pattern includes:

one pair of the longest fins, fins with intermediate lengths arranged between the one pair of the longest fins, and shortest fins arranged in every space between the one pair of the longest fins and the fins with intermediate lengths, wherein the arrangement pattern is expanded by adding a fin with an intermediate length longer than the intermediate fin between one of the one pair of longest fins and the shortest fin adjacent to the one of the one pair of longest fins, and adding a fin between the other one of the one pair of longest fins and the other intermediate fin, and wherein the fin spaces increases in sections by $2 \cdot 2^{(n-1)}$ times of a smallest fin space, where $n \geqq 1$.

58. A heat exchanger for a refrigerator comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another to form an arrangement pattern having three fin types of different length arranged adjacently, wherein the arrangement pattern includes:

one pair of the longest fins, fins with intermediate lengths arranged between the one pair of the longest fins, and shortest fins arranged in every space between the one pair of the longest fins and the fins with intermediate lengths, wherein the arrangement pattern further includes adding a fin longer than the longest fin in every space between an intermediate fin and the previously longest fin, wherein the fin spaces formed between adjacent fins in sections have a ratio of 1:3:6.

59. A heat exchanger for a refrigerator comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another to form an arrangement pattern having three fin types of different length arranged adjacently, wherein the arrangement pattern includes:

one pair of the longest fins, fins with intermediate lengths arranged between the one pair of the longest fins, and shortest fins arranged in every space between the one pair of the longest fins and the fins with intermediate lengths, wherein the arrangement pattern further includes adding a fin longer than the longest fin in every space between an intermediate fin and the previously longest fin, wherein the arrangement pattern is expanded by adding a fin with an intermediate length longer than the intermediate fin between the one pair of longest fins and the shortest fin adjacent to the one pair of longest fins, and adding a fin between the other one of the one pair of longest fins and the intermediate fin, and wherein the fin spaces increase in sections by $3 \cdot 2^{(n-1)}$ times a smallest fin space, where $n \geqq 1$.

60. A heat exchanger for a refrigerator comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another to form an arrangement pattern having three fin types of different length arranged adjacently, wherein the arrangement pattern includes:

one pair of the longest fins, fins with intermediate lengths arranged between the one pair of the longest fins, and shortest fins arranged in every space between the one pair of the longest fins and the fins with intermediate lengths, wherein the arrangement pattern further includes two shortest fins in every space between the intermediate fin and the longest fin, and wherein the fin spaces between adjacent fins in sections have a ratio of 1:4:8.

61. A heat exchanger for a refrigerator comprising:

one or more refrigerating tubes for flow of refrigerant;

a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another to form an arrangement pattern having three fin types of different length arranged adjacently, wherein the arrangement pattern includes:

one pair of the longest fins, fins with intermediate lengths arranged between the one pair of the longest fins, and shortest fins arranged in every space between the one pair of longest fins and the fins with intermediate lengths, wherein the arrangement pattern further includes two shortest fins in every space between the intermediate fin and the longest fin, wherein the arrangement pattern is expanded by adding a fin with an intermediate length longer than the intermediate fin between one of the one pair of longest fins and the shortest fin adjacent to the one of the one pair of longest fins, and adding fins arranged between the other one of the one pair of longest fins and the other intermediate fin, and wherein the fin spaces increase in sections by $4 \cdot 2^{(n-1)}$ times of the smallest fin space, where $n \geqq 1$.

62. A heat exchanger for a refrigerator, comprising:

refrigerating tubes for flow of refrigerant;

a plurality of straight fins having lengths different from one another for coupling with the refrigerating tubes in parallel to each other at fixed intervals through pass through holes formed therein, to form sections with fin spaces different from one another, wherein the fin has an upper edge and a bottom edge, both are sloped at an angle.

63. The heat exchanger as claimed in claim 62, wherein the upper edge and the bottom edge have the same slope directions.

64. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another, wherein the section with the smallest fin spaces is 15%–55% of an entire size of the heat exchanger, and wherein the fin spaces formed between adjacent fins in sections have a ratio of 1:2:4.

65. A heat exchanger as claimed in claim 64, wherein the section with the largest fin spaces is less than 18% of the entire size of the heat exchanger.

66. The heat exchanger as claimed in claim 65, wherein the smallest fin space is 6.1 mm–9.1 mm.

67. The heat exchanger as claimed in claim 65, wherein the smallest fin space is 6.5 mm–7.7 mm.

68. The heat exchanger as claimed in claim 64, wherein the section with the largest fin spaces is less than 18%–35% of the entire size of the heat exchanger.

69. A heat exchanger for a refrigerator, comprising:

one or more refrigerating tubes for flow of refrigerant; and a plurality of fins having lengths different from one another for coupling with the one or more refrigerating tubes having portions arranged substantially in parallel to one another at fixed intervals, the one or more refrigerating tubes passing through pass through holes formed in the plurality of fins, to form sections having fin spaces formed between the fins different in size from one another, wherein the section with the smallest fin spaces is 15%–55% of an entire size of the heat exchanger, wherein the smallest fin space is 4 mm–10 mm, and wherein the fin spaces increase by $2 \cdot 2^{(n-1)}$ times of the smallest fin space, where $n \geqq 1$.

* * * * *